US010612553B2

(12) United States Patent
McPherson et al.

(10) Patent No.: US 10,612,553 B2
(45) Date of Patent: Apr. 7, 2020

(54) ELECTRONIC CEILING FAN CONTROL SYSTEM AND METHOD OF USE

(71) Applicant: Hunter Fan Company, Memphis, TN (US)

(72) Inventors: Matthew McPherson, Memphis, TN (US); Jeremy Tarr, Oakland, TN (US)

(73) Assignee: Hunter Fan Company, Memphis, TN (US)

( * ) Notice: Subject to any disclaimer, the term of this patent is extended or adjusted under 35 U.S.C. 154(b) by 239 days.

(21) Appl. No.: 14/824,758

(22) Filed: Aug. 12, 2015

(65) Prior Publication Data

US 2016/0047391 A1 Feb. 18, 2016

Related U.S. Application Data

(60) Provisional application No. 62/036,604, filed on Aug. 12, 2014.

(51) Int. Cl.
*F04D 25/08* (2006.01)
*F04D 25/06* (2006.01)

(52) U.S. Cl.
CPC ..... *F04D 25/088* (2013.01); *F04D 25/068* (2013.01); *F04D 25/0693* (2013.01)

(58) Field of Classification Search
None
See application file for complete search history.

(56) References Cited

U.S. PATENT DOCUMENTS 1,966,091 A * 7/1934 Gaynor ..... H01H 23/04 200/298
4,494,055 A 1/1985 Bitting et al.
4,538,973 A * 9/1985 Angott ..... G08C 17/02 174/54
4,621,992 A * 11/1986 Angott ..... H05B 39/08 174/54

(Continued)

FOREIGN PATENT DOCUMENTS

CN 201354746 Y 12/2009
CN 203756574 U 8/2014

OTHER PUBLICATIONS

International Search Report and Written Opinion for Counterpart PCT/US2015/044854, dated Dec. 7, 2015.

*Primary Examiner* — Peter J Bertheaud
*Assistant Examiner* — Geoffrey S Lee
(74) *Attorney, Agent, or Firm* — McGarry Bair PC

(57) ABSTRACT

A ceiling fan includes a fan motor housing; a motor positioned within the motor housing; a plurality of fan blades rotatable by the motor; a fan controller and a wired remote control. The fan controller includes a printed circuit board (PCB) having a wireless communication module and an electronic circuit coupled with the wireless communication module and is configured to control the motor to rotate the plurality of fan blades. The wired remote control device is coupled to the printed circuit board and is configured to send user selected signals to the electronic circuit on a first frequency. The electronic circuit is configured to be responsive to signals from the wired remote control device on the first frequency and to be responsive to signals from the wireless communication module on a second frequency.

18 Claims, 23 Drawing Sheets

(56) References Cited

U.S. PATENT DOCUMENTS 4,668,876 A * 5/1987 Skarman ..... H02M 5/2576 200/600
4,686,380 A * 8/1987 Angott ..... G08C 17/02 307/113
4,716,409 A 12/1987 Hart et al.
5,033,113 A * 7/1991 Wang ..... H04B 10/114 318/16
5,189,412 A * 2/1993 Mehta ..... G05B 19/108 340/12.24
5,365,154 A 11/1994 Schneider et al.
5,491,463 A * 2/1996 Sargeant ..... H04B 3/542 340/12.37
5,528,229 A 6/1996 Mehta
5,541,584 A 7/1996 Mehta et al.
5,554,979 A * 9/1996 Kohar ..... G08C 23/04 160/168.1 P
5,668,446 A * 9/1997 Baker ..... H05B 37/02 315/158
5,738,496 A * 4/1998 Mehta ..... F04D 25/088 340/12.22
5,900,682 A 5/1999 Hung
5,951,074 A 9/1999 Guzzi et al.
6,120,262 A 9/2000 McDonough et al.
6,447,362 B2 * 9/2002 Khamphilavong .. A63H 33/006 40/455
6,548,967 B1 * 4/2003 Dowling ..... G06Q 30/0201 315/307
6,559,757 B1 * 5/2003 Deller ..... H04B 3/54 307/3
7,221,106 B1 * 5/2007 Nemir ..... H02M 5/2573 307/132 R
7,565,225 B2 * 7/2009 Dushane ..... G05B 19/042 700/276
7,652,439 B2 1/2010 Tang
7,703,389 B2 * 4/2010 McLemore ..... A47J 37/1209 340/501
7,880,394 B2 * 2/2011 Sibalich ..... H05B 37/0218 315/149
7,948,189 B2 * 5/2011 Ahmed ..... H05B 37/0218 315/291
8,035,320 B2 * 10/2011 Sibert ..... H05B 37/0245 315/149
8,325,040 B2 * 12/2012 Nassimi ..... H05B 37/0218 340/567
9,506,640 B1 * 11/2016 Burns ..... F21V 23/0485
2001/0055931 A1 * 12/2001 Khamphilavong .. A63H 33/006 446/227
2002/0064380 A1 * 5/2002 Reiker ..... F04D 25/088 392/364
2003/0228142 A1 * 12/2003 Reiker ..... F04D 25/088 392/364
2004/0065532 A1 * 4/2004 Wei ..... H01H 17/08 200/33 C
2005/0025637 A1 2/2005 Liao
2005/0115814 A1 * 6/2005 Wei ..... H01H 17/08 200/331
2005/0141997 A1 * 6/2005 Rast ..... F04D 25/088 416/229 R
2006/0254432 A1 * 11/2006 McLemore ..... A47J 37/1209 99/448
2008/0037962 A1 2/2008 Peng et al.
2009/0066197 A1 * 3/2009 Chen ..... F04D 25/0606 310/68 B
2009/0208333 A1 * 8/2009 Smith ..... F04D 25/088 416/5
2010/0278637 A1 * 11/2010 Oleson ..... F04D 25/088 415/121.3
2010/0314941 A1 12/2010 Schulzman
2010/0327766 A1 * 12/2010 Recker ..... H02J 9/02 315/291
2012/0286940 A1 * 11/2012 Carmen, Jr. ..... F21V 33/0052 340/12.5
2013/0010018 A1 * 1/2013 Economy ..... H05B 37/0272 345/691
2013/0026947 A1 * 1/2013 Economy ..... H05B 37/0272 315/287
2013/0030589 A1 * 1/2013 Pessina ..... H05B 37/0272 700/295
2013/0186964 A1 * 7/2013 Simon ..... F24F 11/0012 236/51
2013/0313331 A1 * 11/2013 Warren ..... F24F 11/0012 236/1 C
2015/0211721 A1 * 7/2015 Mornet ..... F21S 41/192 362/547

* cited by examiner

ELECTRONIC CEILING FAN CONTROL SYSTEM AND METHOD OF USE

CROSS-REFERENCE TO RELATED APPLICATIONS

This application claims the benefit of U.S. Provisional Patent Application No. 62/036,604, filed Aug. 12, 2014, which is incorporated herein by reference in its entirety.

FIELD

The disclosure is related to a ceiling fan control system and method of use. More specifically, this disclosure is related to an electronic ceiling fan control system and method for controlling and manipulating the basic, as well as enhanced, features of a ceiling fan or wireless device.

BACKGROUND

For many years, ceiling fans have been widely used to provide a cooling function as well as a lighting function to consumers. Controlling such cooling and lighting functions of existing ceiling fans is complex and cumbersome for the user, with such fans having limited incremental features. Ceiling fans offer cooling and lighting functional features which are usually operated by one or more pull chains and/or by a remote control. Such cooling feature typically includes several speeds: high, medium, low and off. The lighting feature of the fan typically includes the options: on, off, and incremental dimming.

The cooling and lighting features are typically mechanically operated by pull chains and reverse switches. Existing ceiling fans comprise switch housings that contain the mechanical hardware which provides the operation to the functional features of the ceiling fan. Such mechanical hardware typically includes pull chains switches, a reverse switch, capacitors, a limiter, wiring, and connectors, all of which have size constraints that dictate the size and location of the switch housing. The switch housing interfaces with a standard 9-pin connector which serves as a universal connection point to provide power to lights, accessories and the motor of the fan.

Operating and/or controlling the cooling and lighting features of a ceiling fan by pull chains has its disadvantages. A ceiling fan typically includes two pull chains, a first pull chain for controlling the fan speed and the second pull chain for controlling the lighting feature. Although the pull chains are often labeled to clarify which pull chain provides which function, these labels are not readily visible and consumers are often confused as to which pull chain provides the desired function. Moreover, consumers often get frustrated when manipulating the pull chains resulting in multiple consecutive unnecessary actuations of the pull chains to achieve the desired fan function. Additionally, because the ceiling fan is secured to the ceiling and suspended therefrom, the pull chains are often difficult for users to reach depending on the height of the user or the height of the ceiling fan suspension. Another disadvantage to pull chains is that such pull chains may also be a distraction during the operation of the ceiling fan. For example, the two pull chains may sway during the operation of the fan which may lead the consumer to believe the ceiling fan is wobbling.

Ceiling fans also typically include a reverse switch which controls the rotary direction of the motor and thus the direction of the air flow. Controlling the direction of the air flow via a reverse switch is also difficult for the consumer due to the reverse switch being located on the switch housing of the suspended ceiling fan. Although a simple switch to operate, the reverse switch is difficult for the consumer to reach, and therefore operate, due to the elevated location of the ceiling fan.

Ceiling fans features, such as the cooling and lighting functions, may also be controlled by remote control operation. Such remote control operation includes using a remote controller to transmit wireless signals to the ceiling fan. Those signals are received by a receiving unit housed within the canopy of the ceiling fan to control the cooling and lighting operations of the ceiling fan. Operating and/or controlling the ceiling fan by an accessory remote control operation also has its disadvantages, including the expense and difficulty associated with the installation of the required canopy mounted receiver. Additionally, any maintenance and service required is extremely difficult, making it practical to install the remote control feature at initial installation. Moreover, while accessory remote control operation may provide the cooling and lighting functional features, such remote control operation is unable to provide control of the reverse air flow feature; and thus a reverse switch, which requires manual operation, must still be used in addition to an accessory remote control operation.

Moreover, the existing methods used to control a ceiling fan are limiting due to the fact that only one fan may be controlled and manipulated by such methods at any one time. For example, when controlling a fan by pull chains, only one fan is connected to the pull chain switches and thus only one fan is capable of being controlled by the manipulation of such pull chains. Also, when controlling a fan by accessory remote control, only one remote control transmits signals to one corresponding unit located in such ceiling fan and thus only one fan is capable of being controlled by the remote control.

An electronic ceiling fan control system and method of use to control and manipulate basic functional as well as enhanced features of one or more ceiling fans independently of mechanical operations, utilizing pull chains and reverse switches, is needed. Additionally, an electronic ceiling fan control system and method of use to control and manipulate basic functional features as well as enhanced features of a one or more ceiling fans, wherein such system provides a remote ready ceiling fan, is needed to avoid present remote control installation complications. Moreover, an electronic ceiling fan control system and method of use to control and manipulate basic as well as enhanced functional features of a plurality of ceiling fans located within a defined location, wherein such fan control and manipulation is performed via a wireless device, is needed

BRIEF DESCRIPTION

In one aspect, a control for a ceiling fan comprises a printed circuit board (PCB) having a wireless communication module and an electronic circuit coupled with the wireless communication module and configured to operate a ceiling fan; and a wired remote control device coupled to the printed circuit board and configured to send user selected signals to the electronic circuit on a first frequency. The electronic circuit is configured to be responsive to signals from the wired remote control device on the first frequency and to be responsive to signals from the wireless communication module on a second frequency.

The wired remote control device can include an isolated discrete digital interface for communication to the electronic circuit of the of printed circuit board. The isolated digital interface can include a capacitive or inductive isolation barrier.

The wired remote control device can be removably attached to the printed circuit board.

The wired remote control can further include a jack plug connector, a user interface, and an electronic cable coupled therebetween. The electronic cable can be an audio cable. The user interface can include at least two pushbuttons. The electronic circuit can be configured to reverse a direction of rotation of a plurality of fan blades in response to activation of one of the two pushbuttons.

The signals from the wired remote control device can be pulse width modulated.

The printed circuit board can further include a three way wall switch monitor configured to detect a state of an external light or wall switch.

The control can include a capacitive, transformerless power supply.

The wireless communication module can be configured to communicate by radio frequency, infrared, Bluetooth, near-field communication (NFC) or Wi-Fi.

In another aspect, a ceiling fan comprises a fan motor housing; a motor positioned within the motor housing; a plurality of fan blades rotatable by the motor; a fan controller comprising a printed circuit board having a wireless communication module and an electronic circuit coupled with the wireless communication module and configured to control the motor to rotate the plurality of fan blades; and a wired remote control device coupled to the printed circuit board and configured to send user selected signals to the electronic circuit on a first frequency. The electronic circuit is configured to be responsive to signals from the wired remote control device on the first frequency and to be responsive to signals from the wireless communication module on a second frequency.

The ceiling fan can further include at least one light. The electronic circuit can be further configured to control the at least one light in response to the signals from the wired remote control device.

An electronic ceiling fan control system and method of use to control and manipulate the basic functional as well as enhanced features of a ceiling fan independently of mechanical operation, utilizing pull chains and reverse switches, is disclosed. Such electronic fan control system replaces the mechanical control features contained in the switch housing of typical ceiling fans with electronic control features by introducing a printed circuit board. A radio frequency chip on board provides pre-loaded control capability of a ceiling fan. Such radio frequency chip may be paired with a transmitter to allow electronic control of a ceiling fan. In one embodiment, the printed circuit board is interfaced with a connector, such as a 9-pin connector, which provides a connection to supply power to the lights, accessories, and drive motor of the ceiling fan. In one embodiment, the 9-pin connector allows simple installation and backward capability. Such fan control system is remote ready and includes a receiver on board which allows its users the option of a low cost remote control upgrade at the time of installation of a ceiling fan or at any subsequent time after initial installation.

In one embodiment, an electronic ceiling fan control system and method of use may comprise a two buttoned wired control device which is connected to the printed circuit board of the fan controller and is used by a user to control the functional features of a ceiling fan. Such wired control device communicates with the fan controller, and thus eliminates the need for mechanical pull chains. In one embodiment, such control device is removably attached to the fan controller. In another embodiment, such electronic fan control system eliminates the need for the reverse switch typically found on the outside of the switch housing of a ceiling fan. Such reverse switch feature may be controlled by the fan controller 400.

The system includes the equipment and/or electrical components for allowing the transmission of communication signals between the wired control device and the ceiling fan controller on a first frequency. In another embodiment, a wireless control device may be used to communicate with the ceiling fan controller. The system herein disclosed includes the equipment and/or electrical components for allowing the transmission of wireless communication signals between a wireless control device and the remote ready ceiling fan controller on a second frequency which is different from the first frequency.

An electronic ceiling fan control system may comprise a radio frequency chip on board which provides pre-loaded control capability of the basic functional features of a ceiling fan as well as enhanced features. Such control capability may be personalized according to the needs and desires of its users. Such electronic control system and method of use provides a full featured fan controller having the hardware, software and electrical components for multiple built in control options including radio frequency communication, IR, PIR, Bluetooth low energy communication, WIFI, touch sense, voice recognition, motion sensing, occupancy sensing, temperature activation, level lights and home automation.

In one embodiment, such electronic control system may comprise a full featured fan controller having the hardware, software and electrical components for providing the additional functional features including off premises control capability which includes status confirmation and control; scheduling capability which includes programming vacation mode and security lights; scene selection capability which allows personalized setting of a ceiling fan's cooling and lighting functions depending on the activity of a user such as when a user may be watching a movie, exercising or sleeping; alarm clock capability which may include waking the user gently with fan operation creating a sunrise light or wind gust; and remote diagnostics capability which may include analyzing and troubleshooting consumer issues.

Compatible application may comprise additional application features including a notification feature which may include push notifications to change direction of blades, product launches, and sales; a registration feature which may include collecting user data in setup process and building a database for marketing and support; and a data feature which may include collecting data to understand how products are used by consumers to allow advancement and modifications of product and/or partnerships with others in industry such as utility companies.

In one embodiment, such electronic control system may comprise a full featured fan controller having the hardware and electrical components for multiple built in features which may include bidirectional radio frequency data communication in the 433 Mhz range; fully down-light control; audible feedback to the user; and integrated reversing module. The electronic control system may comprise the equipment or components for upgrading functionality of a ceiling fan including smart light module for additional lights; dumb light module with direct control from fan controller; light module interface which can also be used for ceiling fan peripherals (e.g., heater); and radio frequency module interface for expanding wireless communication capability, including Bluetooth low energy, Wi-Fi, and Zigbee.

In one embodiment, the wireless control device may be operable to communicate data messages via wireless signals such as radio frequency signals to one or more fan controllers via a direct wireless communication link, such as Bluetooth communication technology owned by Bluetooth Sig, Inc. The wireless control device may be operable to establish a wireless communication link with one or more fan controllers.

The preceding summary is provided to facilitate an understanding of some of the innovative features unique to the present disclosure and is not intended to be a full description. A full appreciation of the present disclosure may be gained by taking into consideration the entire specification including the drawings.

DETAILED DESCRIPTION

With reference next to the drawings, there is shown an electronic fan control system and method of use for controlling and manipulating functional features of a ceiling fan 100 in a preferred form of the invention.

Regarding FIGS. 1 to 3B, a ceiling fan 100 having a ceiling fan control system according to one embodiment is disclosed.

Figure 1:
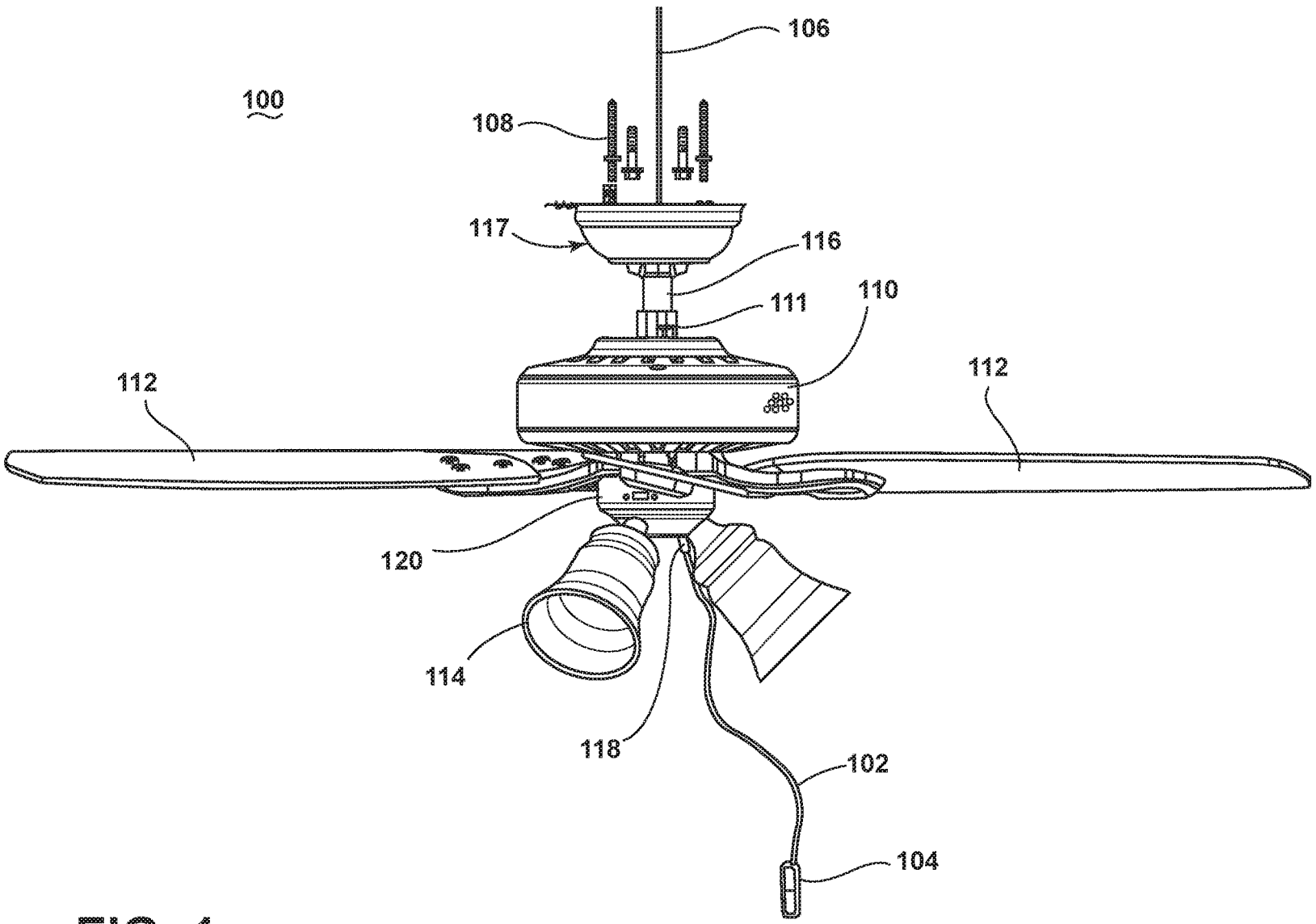
FIG. 1 is a side view of a ceiling fan having a ceiling fan control system according to one embodiment.

Referring to FIG. 1, a side view of a ceiling fan 100 having a ceiling fan control system according to one embodiment is shown. The ceiling fan 100 includes a fan motor housing 110, a motor positioned within the motor housing, a downrod coupler 111 mounted to the top end of the motor, and a hollow downrod 116 extending upwardly from the downrod coupler 111 to the ceiling fan canopy assembly 117 which is coupled to the ceiling of a structure by various fasteners 108. The ceiling fan 100 also includes a plurality of fan blades 112, a fan controller 120 and an optional light kit 114. Coupled to the fan controller 120 via jack plug 118, a wired remote control device 102 with pushbutton interface 104 allows for control of the ceiling fan 100. The fan electrical wires 106 are coupled or spliced to the structure or building electrical wires at the ceiling fan canopy 117 and provide electrical power for the motor, the optional light kit 114 and fan controller 120.

Figure 2:
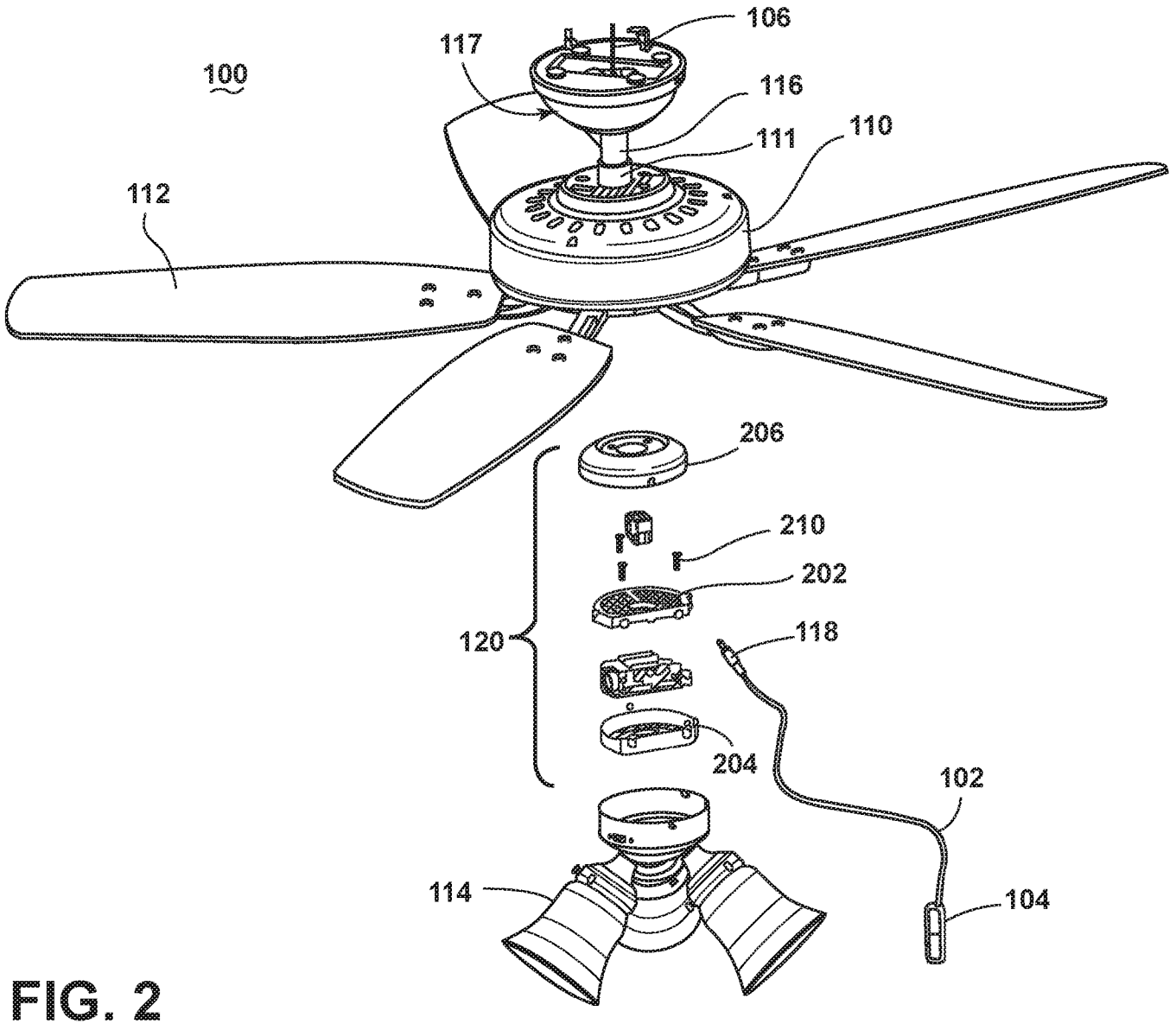
FIG. 2 is an exploded, perspective view of the hardware components of FIG. 1.

FIG. 2 is an exploded, perspective view of the hardware components of FIG. 1. The fan controller 400 includes a first housing having a cover portion 202 and base portion 204. The housing for the fan controller 120 can include a second cover portion 206 and a portion shown as part of the light kit 114. A plurality of fasteners 210 can be used to assemble the components of fan controller 120.

Figure 3A:
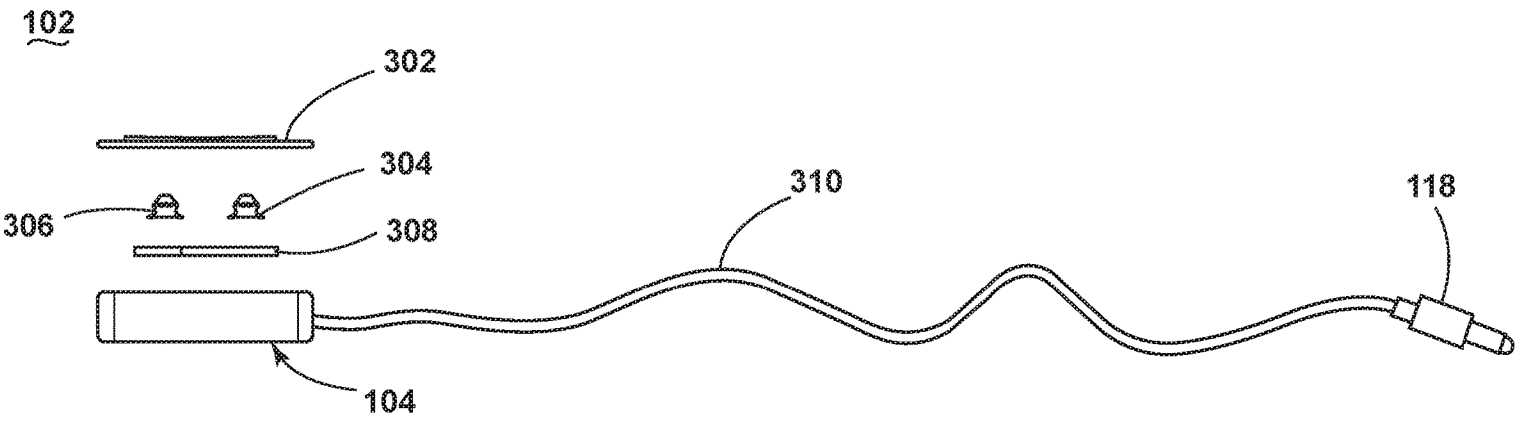
FIG. 3A is a side view of a wired remote control device according to one embodiment.
Figure 3B:
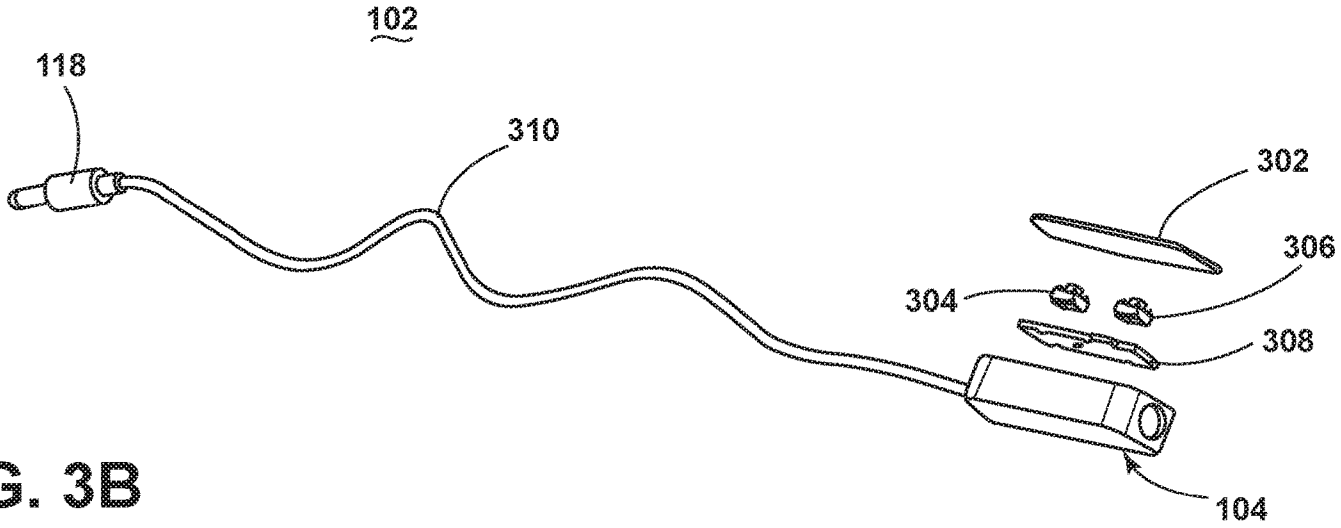
FIG. 3B is an exploded, perspective view of a wired remote control device of FIG. 3A.
Figure 4:
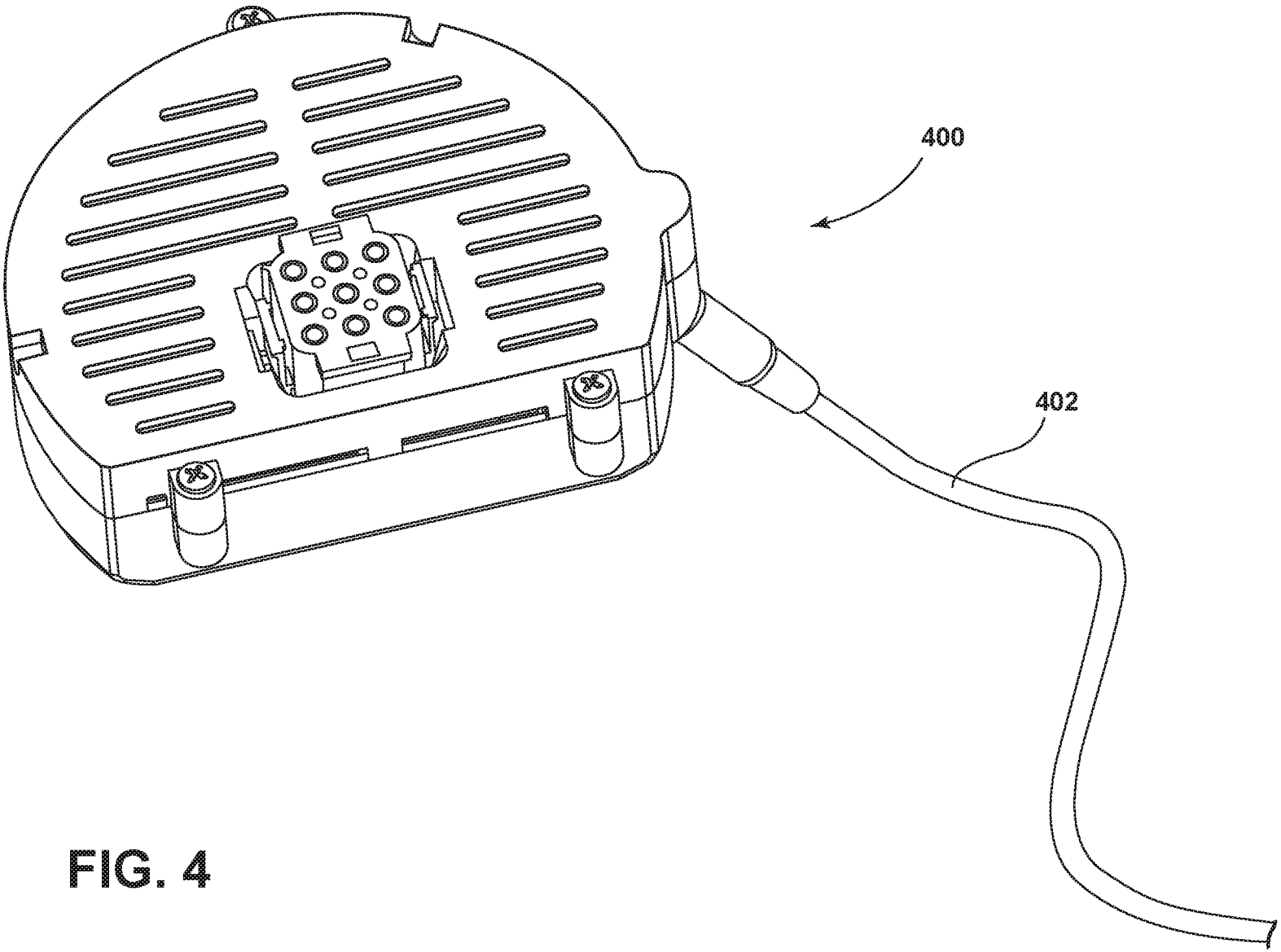
FIG. 4 is a perspective view of the fan controller with wired remote according to one embodiment.
Figure 5:
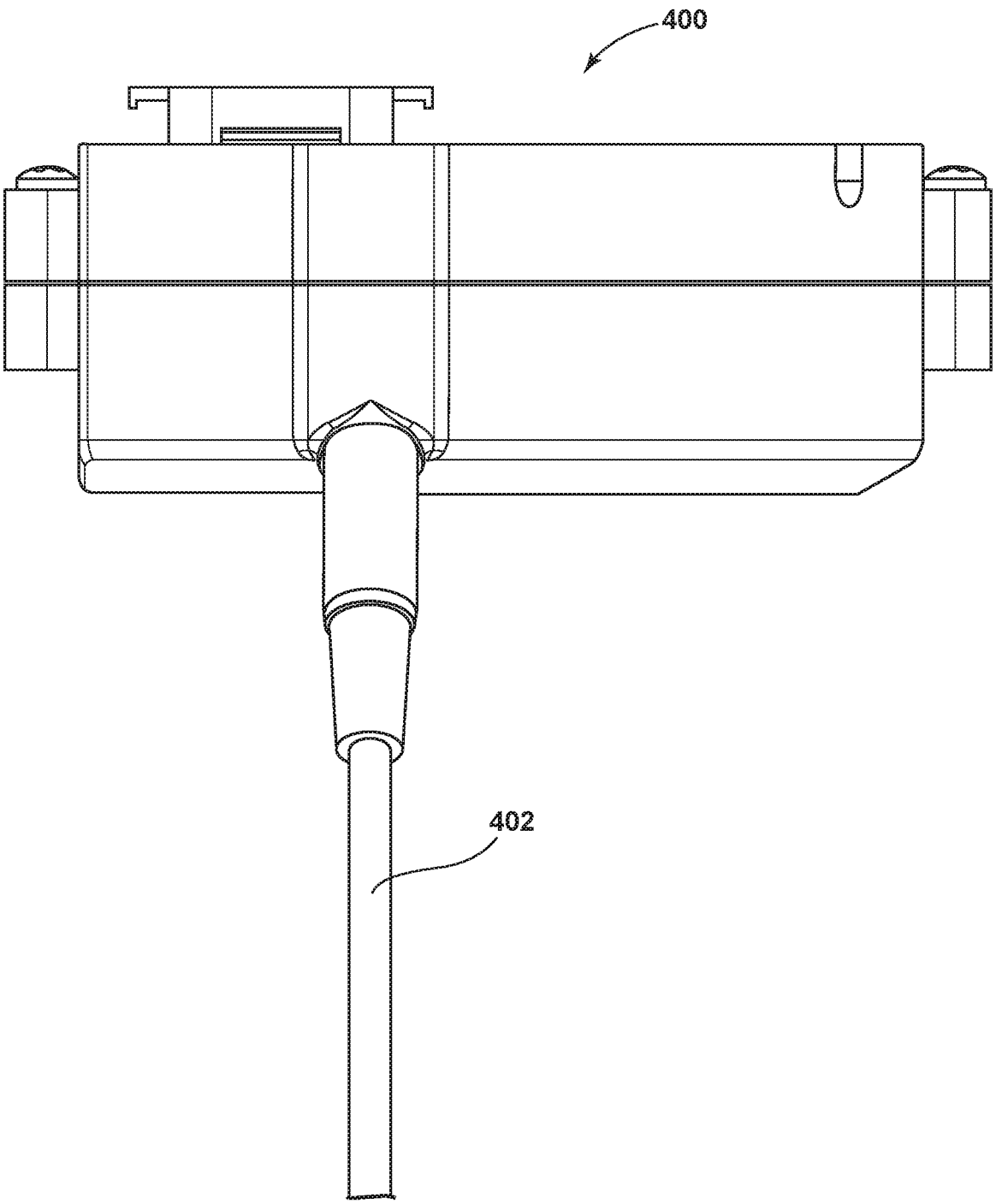
FIG. 5 is a perspective view of a fan controller with wired remote of FIG. 4.
Figure 6:
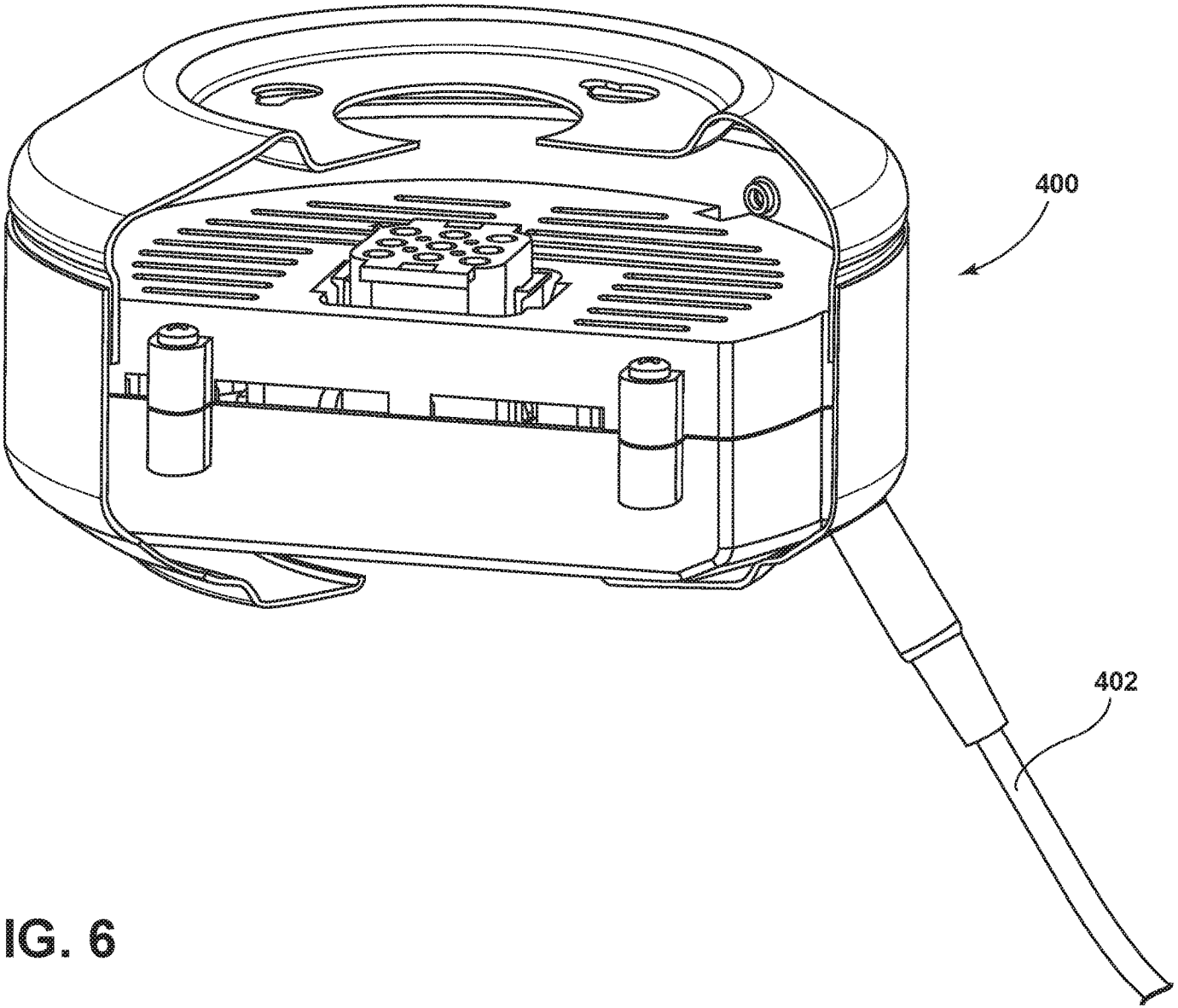
FIG. 6 is a perspective view of a fan controller with wired remote wherein the fan controller is shown encased in a switch housing of a fan wherein a portion of the switch housing is omitted.

FIGS. 3A and 3B disclose a wired remote control device 102. The wired remote control device 102 includes a jack plug 118, an electronic cable 310 coupled to the jack plug 118 and an interface 104 coupled to the electronic cable 310. The interface 104 includes a cover 302, one or more pushbuttons 304, 306 and a printed circuit board 308 on which the pushbuttons 304, 306 are mounted. The interface 104 can include any electronic or mechanical interface elements suitable for communicating between a user and a fan controller including but not limited to buttons, knobs, touch elements, lighted components, switches, etc.

The interface 104 includes a low-cost isolated discrete digital interface with an isolation barrier by using a pulse-width modulated (PWM) digital pulse to excite a passive electrical circuit. In operation, the wired remote device includes a pulse-width modulated (PWM) digital pulse that excites passive electrical circuit elements. When the switches indicative of a user operating the interface of the wired remote device are closed, a signal is returned through the circuit. Because the PWM signal is DC coupled, it is not referenced to the digital ground when it returns and therefore does not to inspect the signal value just after these capacitors in order to determine the switch state. The ground path provides a low impedance path for the PWM signal to return when no buttons are closed to allow the circuit to operate with common, off-the-shelf audio cables that have a tightly coupled shield to the signal wires.

Figure 7:
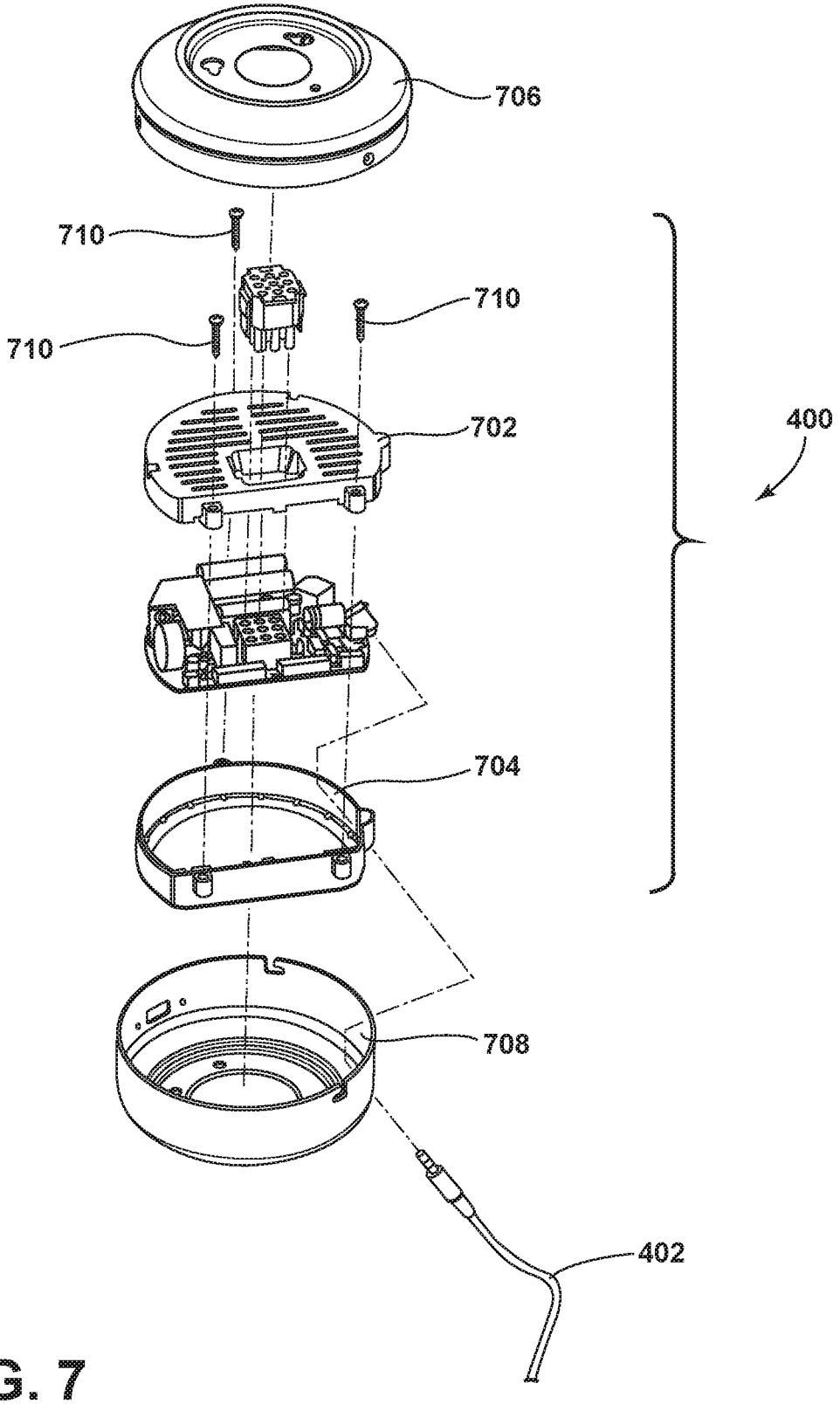
FIG. 7 is an exploded view of the hardware components of a fan controller with removably attached wired remote control device.

Referring to FIGS. 4 to 7, in one example embodiment, an electronic ceiling fan controller 400 with a wired remote control device 402 is disclosed. Referring now to FIG. 7, an exploded view of the hardware components of a ceiling fan controller 400 with a removably attached wired remote control device 402 with at least one button and switch housing is shown according to one example embodiment. The ceiling fan controller 400 may be located in the hardware components of a ceiling fan. In one embodiment, the ceiling fan controller 400 may be located in the switch housing of the fan. The remote ready ceiling fan controller 400 is operable to receive radio signals from wired control device 402 on a first frequency. In one embodiment, the ceiling fan controller 400 of FIG. 7 includes a first housing having a cover portion 702 and base portion 704. In another embodiment, the switch house may comprise a second cover portion 706 and base portion 708. A plurality of fasteners 710 may be used to assemble the components of fan controller 400.

Figure 8:
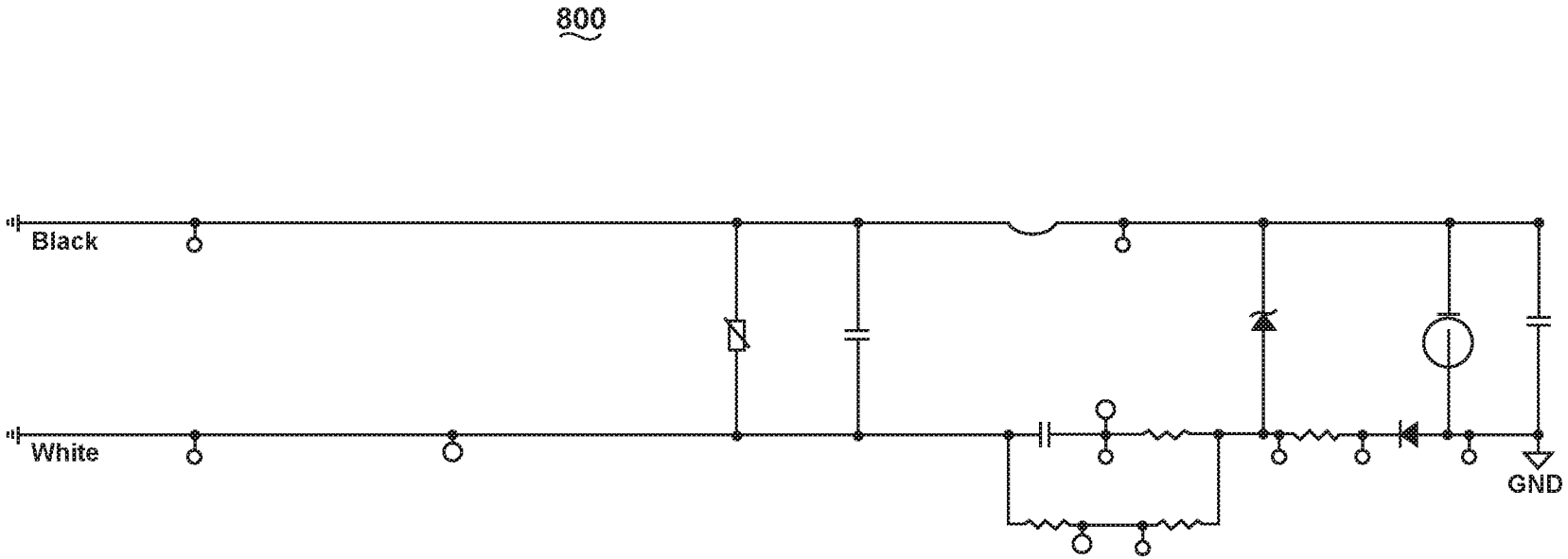
FIG. 8 is a schematic wiring diagram of a control circuit including an offline power circuit.
Figure 9:
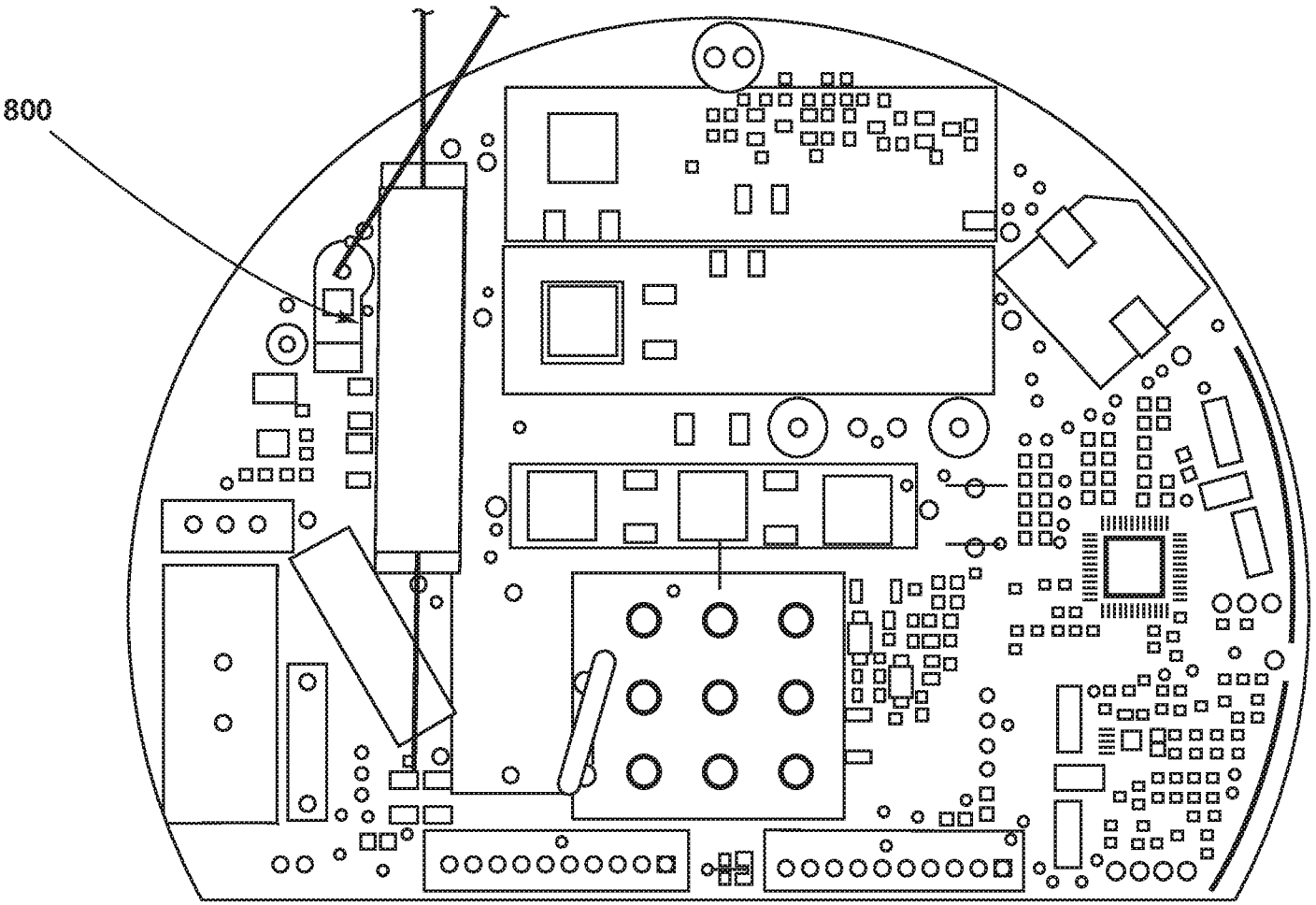
FIG. 9 is an illustrative view of a printed circuit board layout including the layout power circuit of FIG. 8.

In one embodiment, the remote-ready ceiling fan controller 400 may comprise the electrical components shown in FIGS. 8 to 28. Referring now to FIGS. 8 and 9, in one embodiment, the power supply of the fan controller 400 may comprise a capacitive, transformerless power supply 800 as shown in the power supply circuit of FIG. 8. The capacitive, transformerless power supply has the cost and size advantage of eliminating the need for a transformer in the circuit. In one embodiment, the capacitive, transformerless power supply utilizes a coupling capacitor to conduct energy into a regulation circuit. The circuit design of FIG. 8 has the additional advantage of optimizing the size and cost of the high voltage components required to provide power to the radio frequency circuit.

Referring again to FIG. 8, in one embodiment, line voltage may be provided through connections from direct wire connections to the module. Varistor RV 1 may provide circuit protection in cases of over-voltages caused by surges. Capacitor C1 may provide filtering to prevent line noise from coupling to and from the power circuit. Capacitor C2 may be the primary coupling device used to power the circuit. Resistor R31 may be used to limit the inrush current from the line. Resistors R27 and R28 may provide a filter to prevent electromagnetic interference (EMI) from travelling back onto the line. In one embodiment, diode Z1 may provide the regulation on the VDC main rail, limiting the maximum voltage on the VDC main rail. In another embodiment, capacitor C4 may provide the bulk storage for the energy used by the buck regulator circuit.

In one embodiment, the nominal power that the supply may provide is as follows:

Vrms=120 VAC
Vz=12 Volts
f=60 Hz
C4=1.8 uF
R5=100 Ohms $$lin = \frac{\sqrt{2}\cdot V_{rms} - V_z}{2\left(\frac{1}{2\pi f C_4} + R_5\right)} = \frac{\sqrt{2}\cdot 120 - 12}{2\left(\frac{1}{2\pi 60\cdot 1.8e-6} + 100\right)} = 50\ \text{mA}$$

FIG. 9 illustrates a view of a printed circuit board layout that includes the layout power circuit of FIG. 8.

Figure 10A:
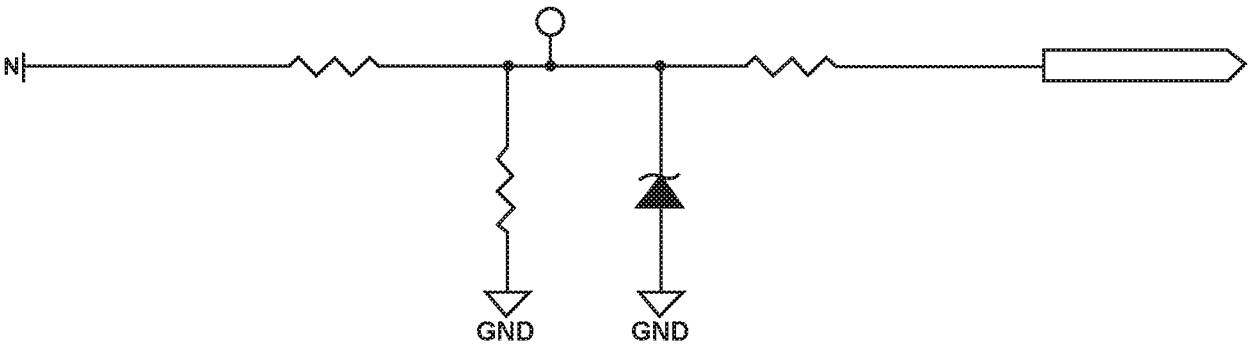
FIG. 10A is a schematic wiring diagram of a control circuit including a zero cross detector.
Figure 10B:
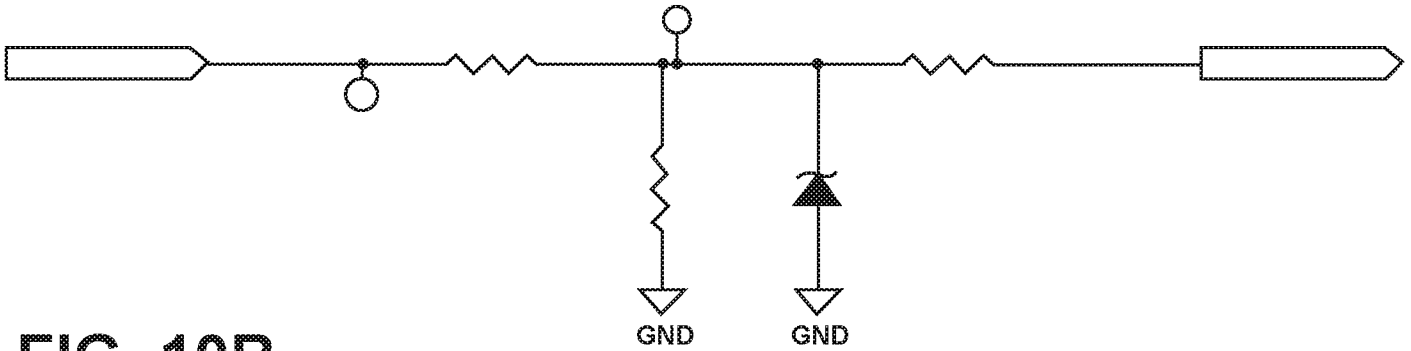
FIG. 10B is a schematic wiring diagram of a control circuit including a three way wall switch monitor.
Figure 11:
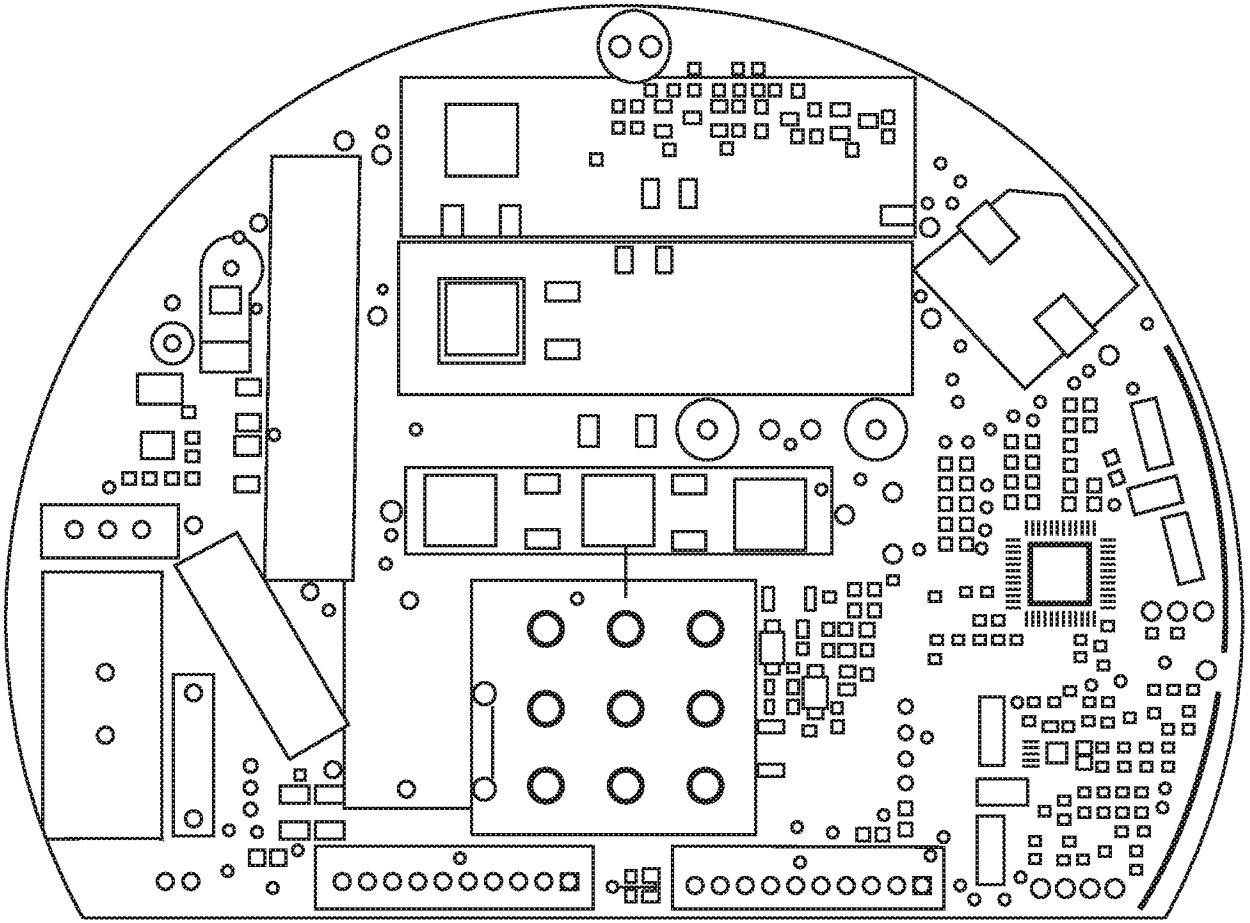
FIG. 11 is an illustrative view of a printed circuit board layout including the layout of the zero cross detection circuits of FIGS. 10A and 10B.

Referring now to FIGS. 10A, 10B and 11, in one embodiment, zero-cross detectors may be used to operate the ceiling fan controller 400. Referring to FIG. 10A, a zero cross detector 1000 may be used to time the firing of the triacs in the motor control circuitry. Referring to FIG. 10B, the three way wall switch monitor 1010 may be used to detect if the external light or wall switch is activated. Software may be used to control the output light switch based on this monitored state. FIG. 11 illustrates a printed circuit board layout that includes the layout of the zero-cross detection circuit 1000 of FIG. 10A and the three way wall switch monitor 1010 of FIG. 10B.

Figure 12:
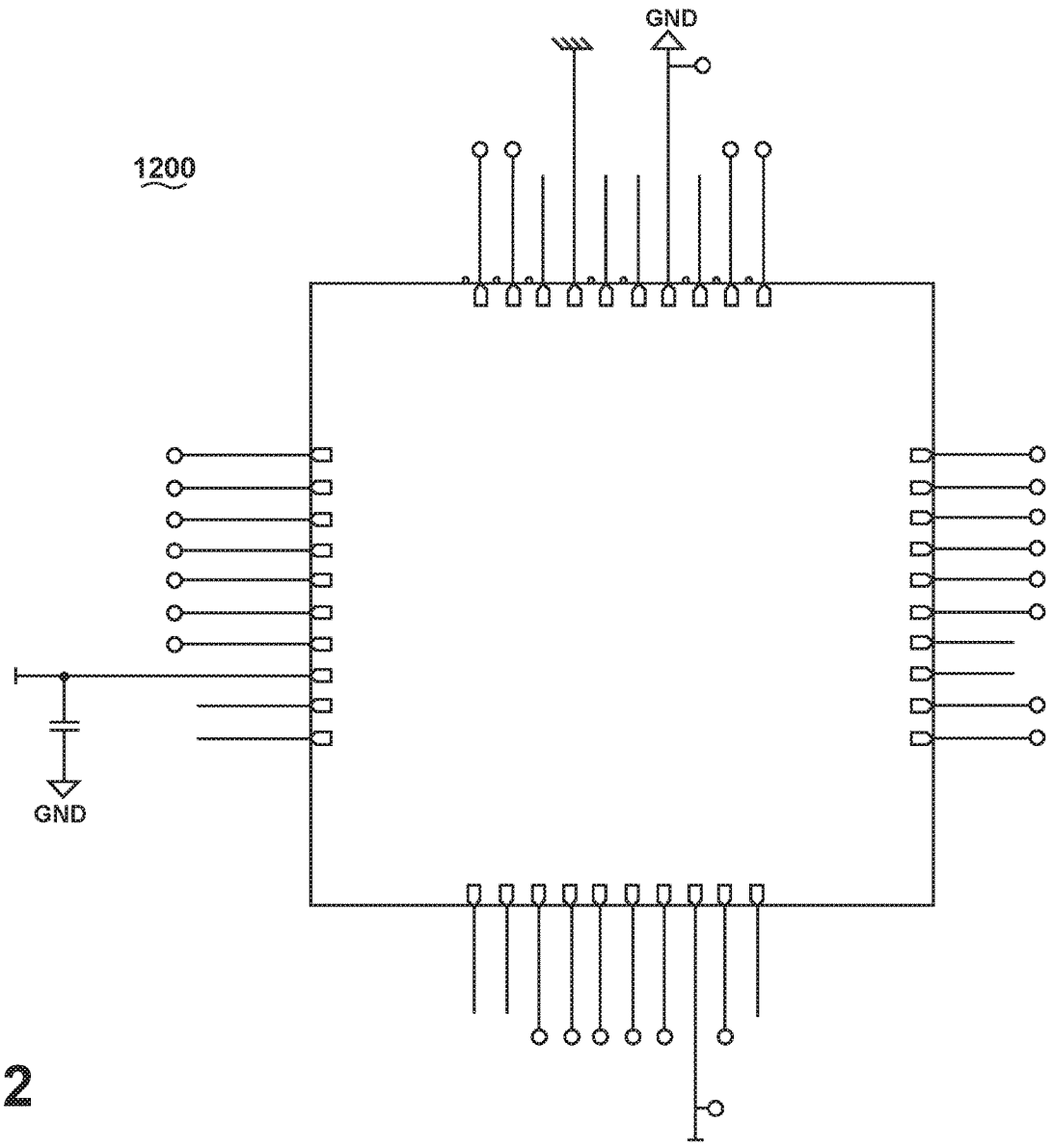
FIG. 12 is a view of an application specific integrated circuit, according to one example embodiment.
Figure 13:
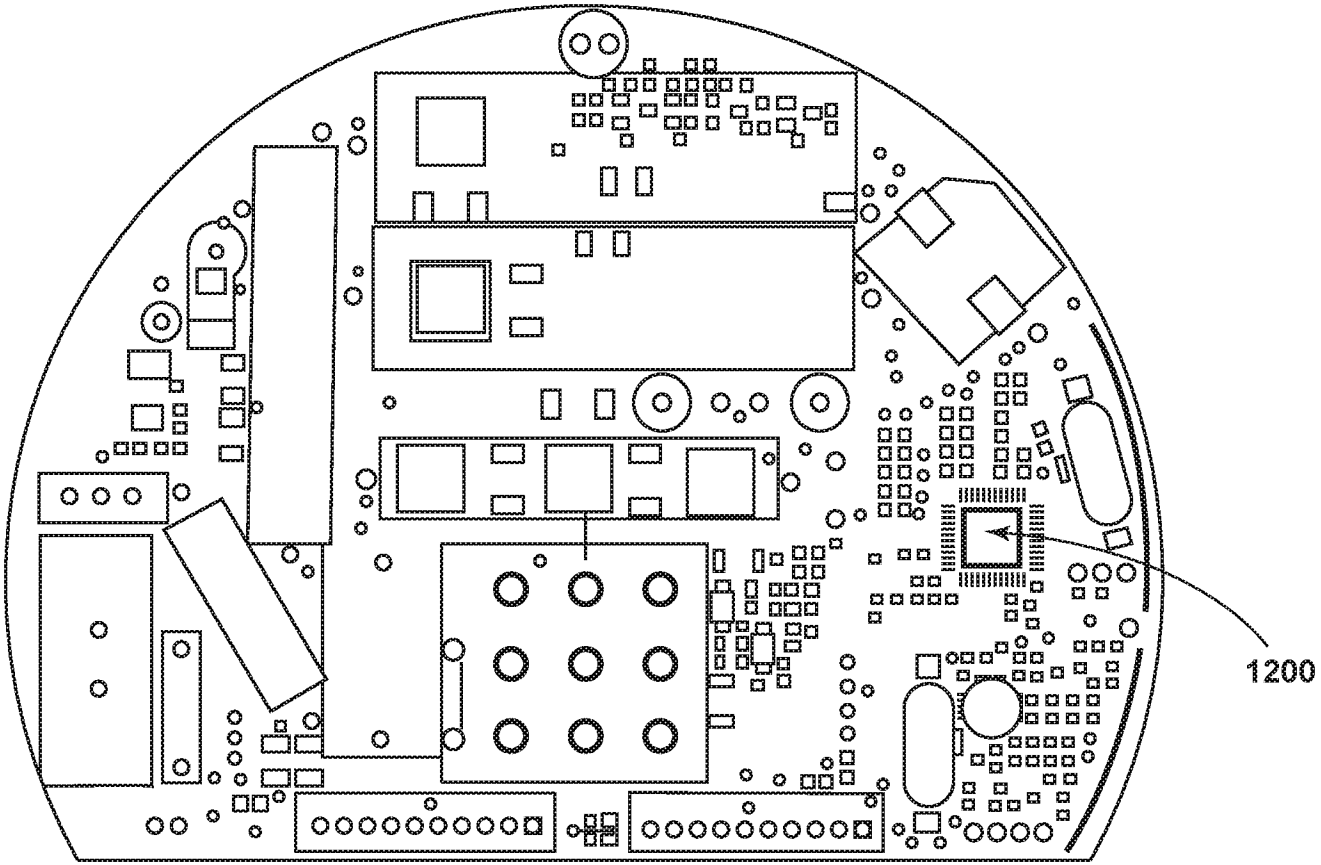
FIG. 13 is an illustrative view of a printed circuit board layout including the application specific integrated circuit.

Referring now to FIGS. 12 and 13, in one embodiment, the ceiling fan controller 400 comprises the fan control transceiver or application specific integrated circuit. In one embodiment, the fan controller 400 is operated by a single application specific integrated circuit (ASIC) 1200. The ASIC 1200 may be mixed signal that contains power conditioning, RF, high voltage line driving, digital logic and an integrated 32 bit microcontroller. Application programming is executed in an ASIC along with customized peripherals for the fan system application. FIG. 13 illustrates a printed circuit board layout that includes the ASIC 1200 of FIG.

Figure 14:
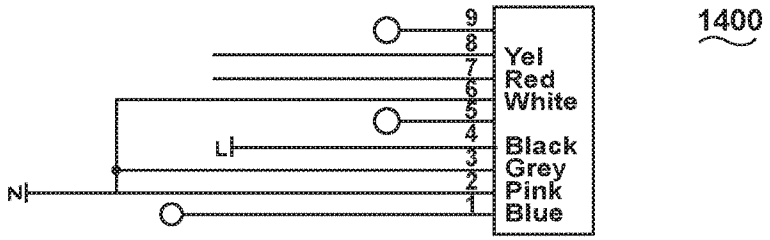
FIG. 14 is an illustrative view of a 9-pin interface.
Figure 15:
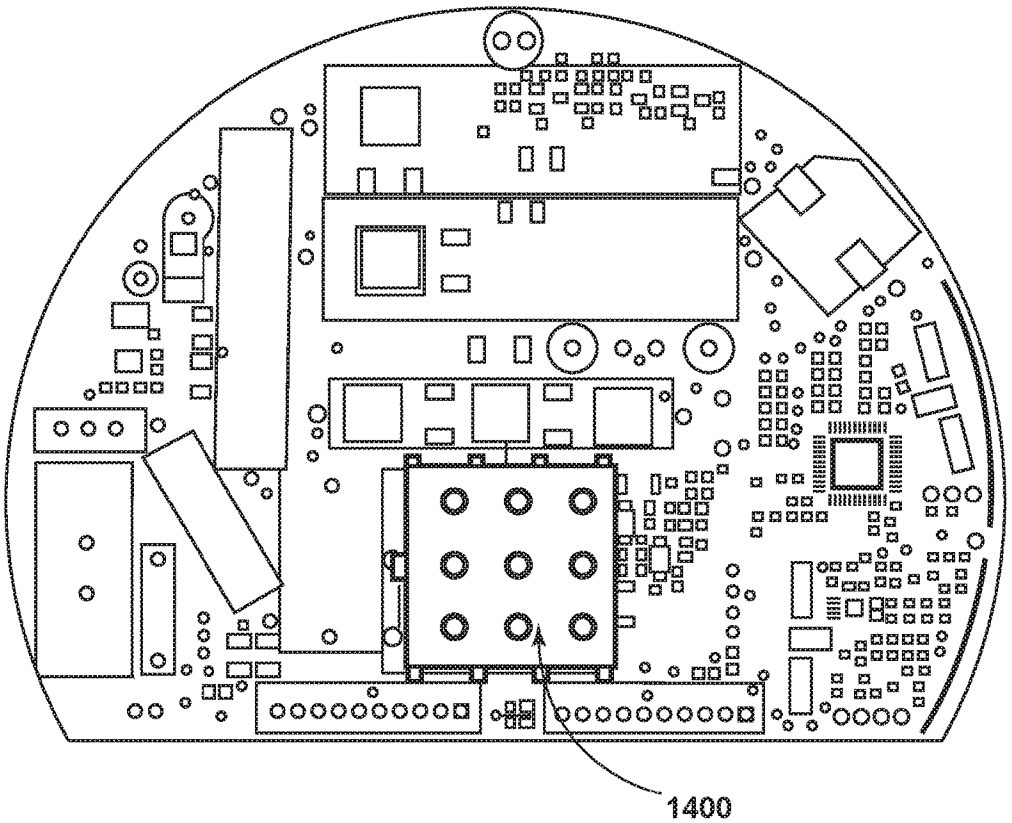
FIG. 15 is an illustrative view of a printed circuit board layout including a 9-pin interface location of FIG. 14.

Referring now to FIGS. 14 and 15, in one embodiment, the fan controller 400 interfaces with the motor and lighting peripherals of a ceiling fan using a standard 9-pin interface 1500. In one embodiment, such standard interface allows the fan controller 400 backwards compatibility to existing fan installations. Alternative interface connections may be used as desired by one of ordinary skill in the art.

Figure 16:
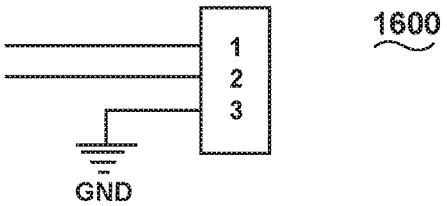
FIG. 16 is an illustrative view of a local remote control device interface.
Figure 17:
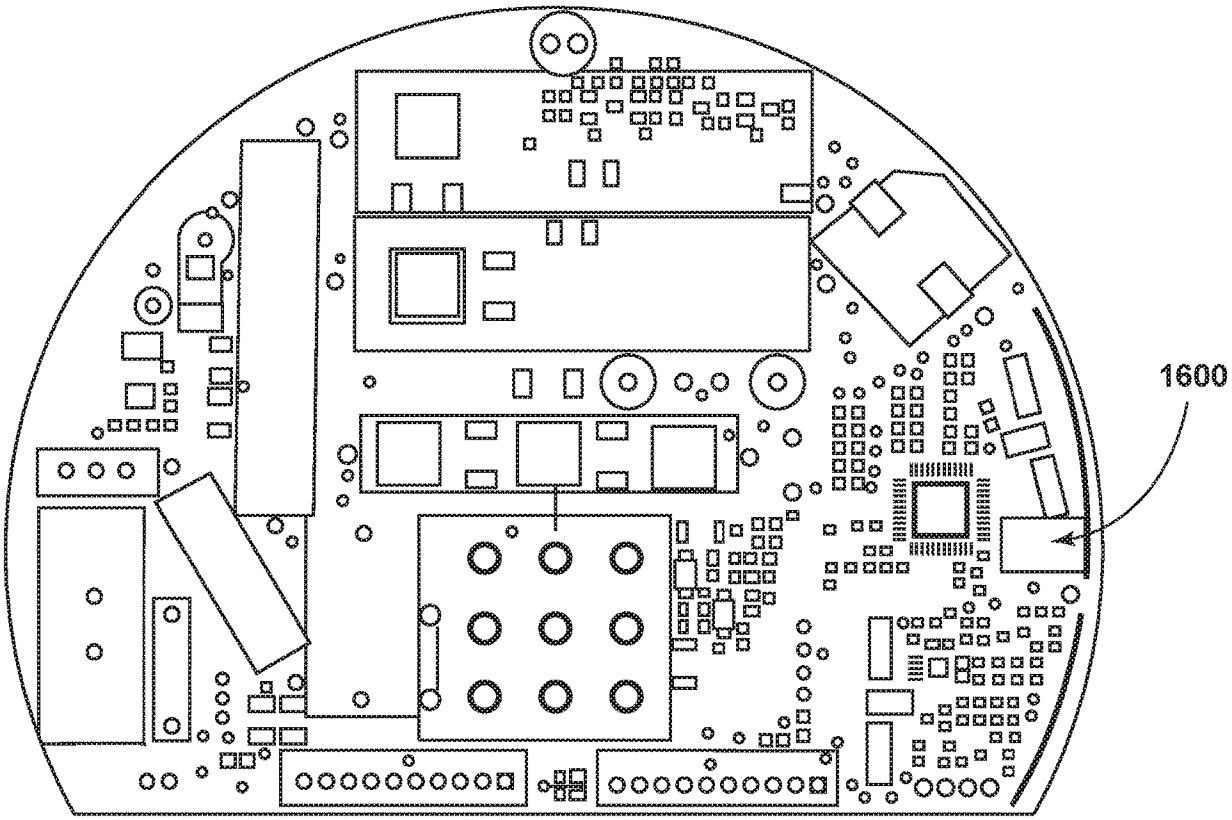
FIG. 17 is an illustrative view of a printed circuit board layout including a local remote control device interface of FIG. 16.

Referring to FIGS. 16 and 17, in one embodiment, the fan controller 400 may comprise a dongle control interface or a local remote interface 1600 which allows the connection of the wired remote device 402. The wired control device 402 allows for direct electronic control without the requirement of a wireless transmitter. In one embodiment, the wired remote control device 402 is a two button wired remote control device. In another embodiment, the wired remote control device 402 may include one button or more than two buttons as desired by one of ordinary skill in the art. In one embodiment, the remote interface 1600 allows monitoring of four states of a ceiling fan. The wired remote control device 402 allows for increased functionality over a mechanical design. In one embodiment, the wired remote control device 402 may be paired to accessory remotes, which may then be used to control the states of a ceiling fan. In another embodiment, the remote interface 1600 allows a user to set preferred cooling and lighting settings, then detach the wired remote control device 402 and control the ceiling fan with wall switches. FIG. 17 shows the location of the local remote interface 1600 according to one example embodiment. Other locations on the printed circuit board may be used as desired by one of ordinary skill in the art.

Figure 18:
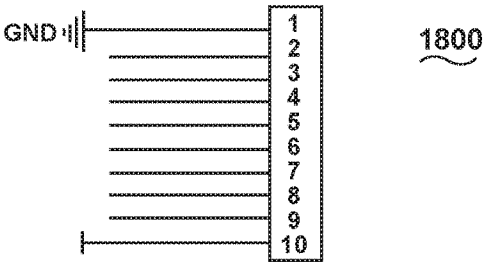
FIG. 18 is an illustrative view of a module interface according to one embodiment.
Figure 19:
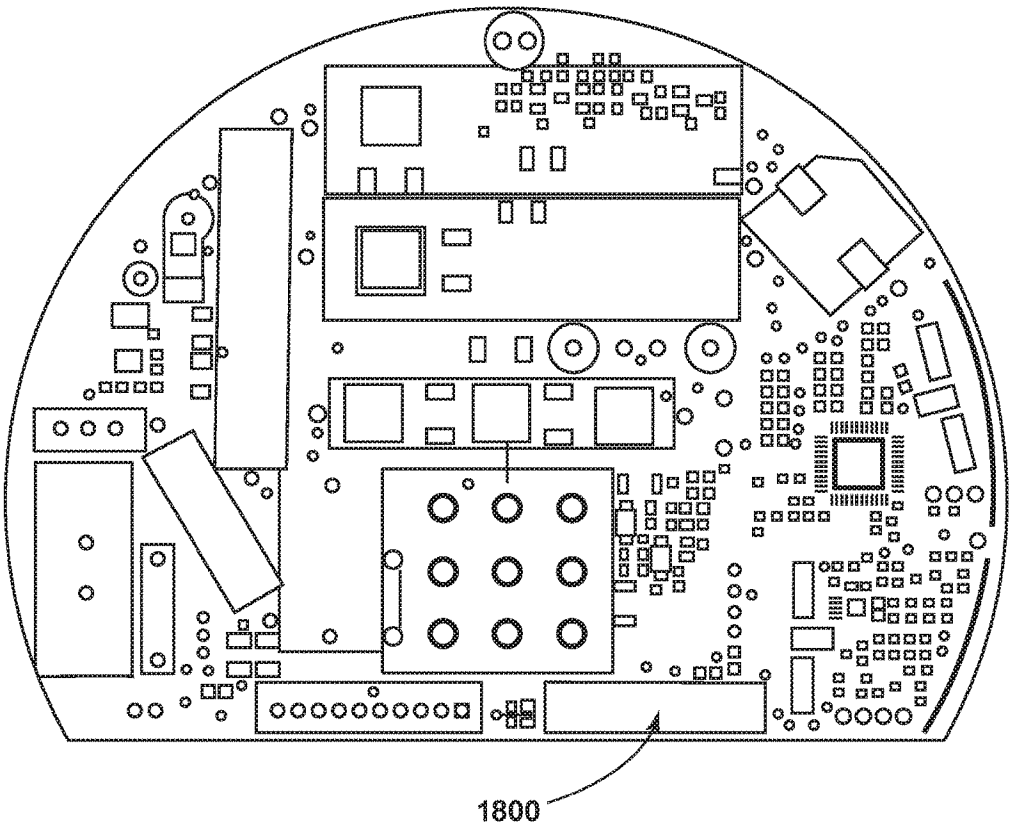
FIG. 19 is an illustrative view of a printed circuit board layout including a module interface of FIG. 18.

Referring to FIGS. 18 and 19, in one embodiment, the fan controller 400 may comprise a module interface 1800 for additional wireless capabilities. In one embodiment, the module interface 1800 may include a UART, SPI and discrete interface for operation. In another embodiment, the module interface 1800 may contain a power interface for running the modules. FIG. 19 shows the location of the module interface 1800 on the printed circuit board according to one example embodiment. Other locations for the module interface may be used as desired by one of ordinary skill in the art.

Figure 20:
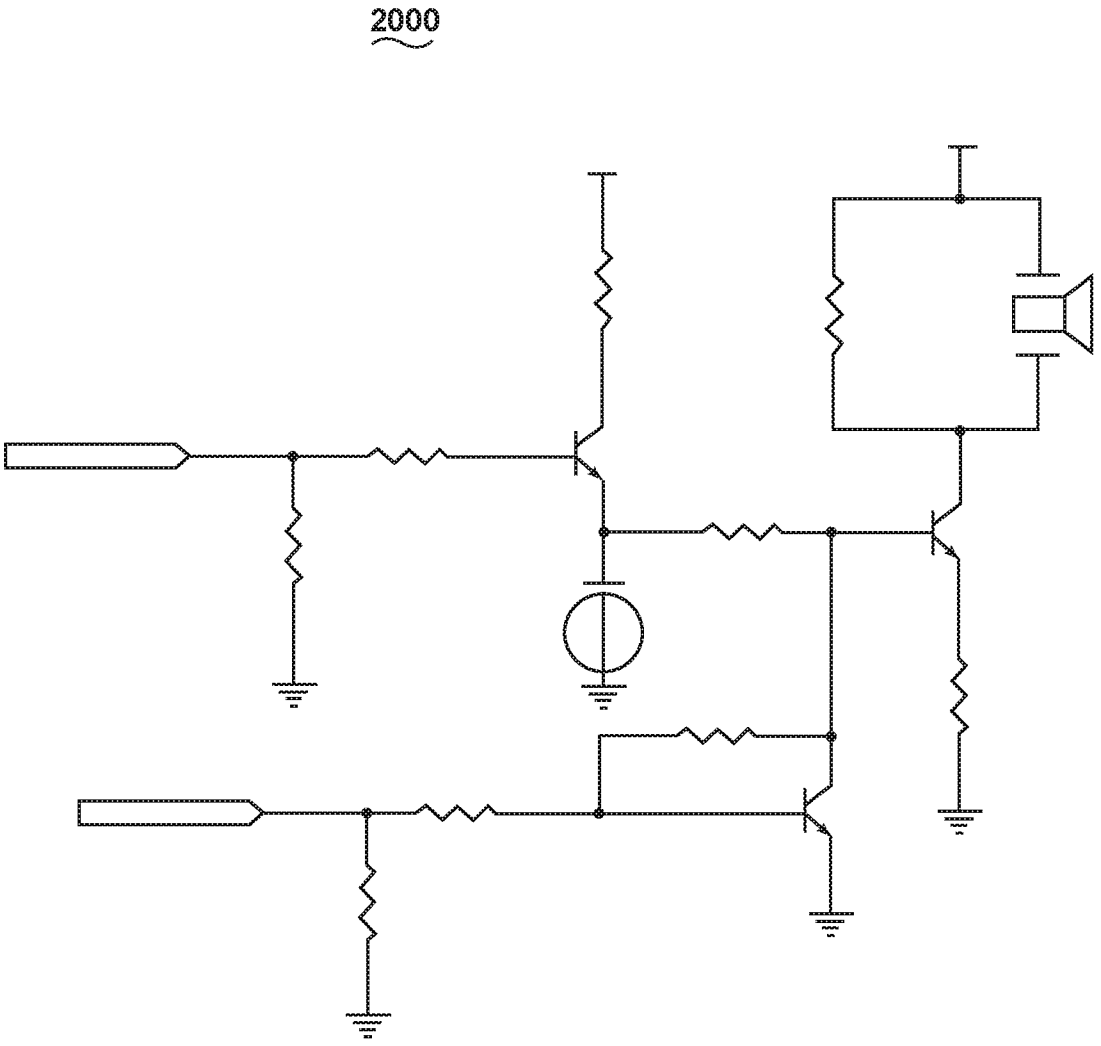
FIG. 20 is a schematic wiring diagram of an audible feedback circuit, according to one embodiment.
Figure 21:
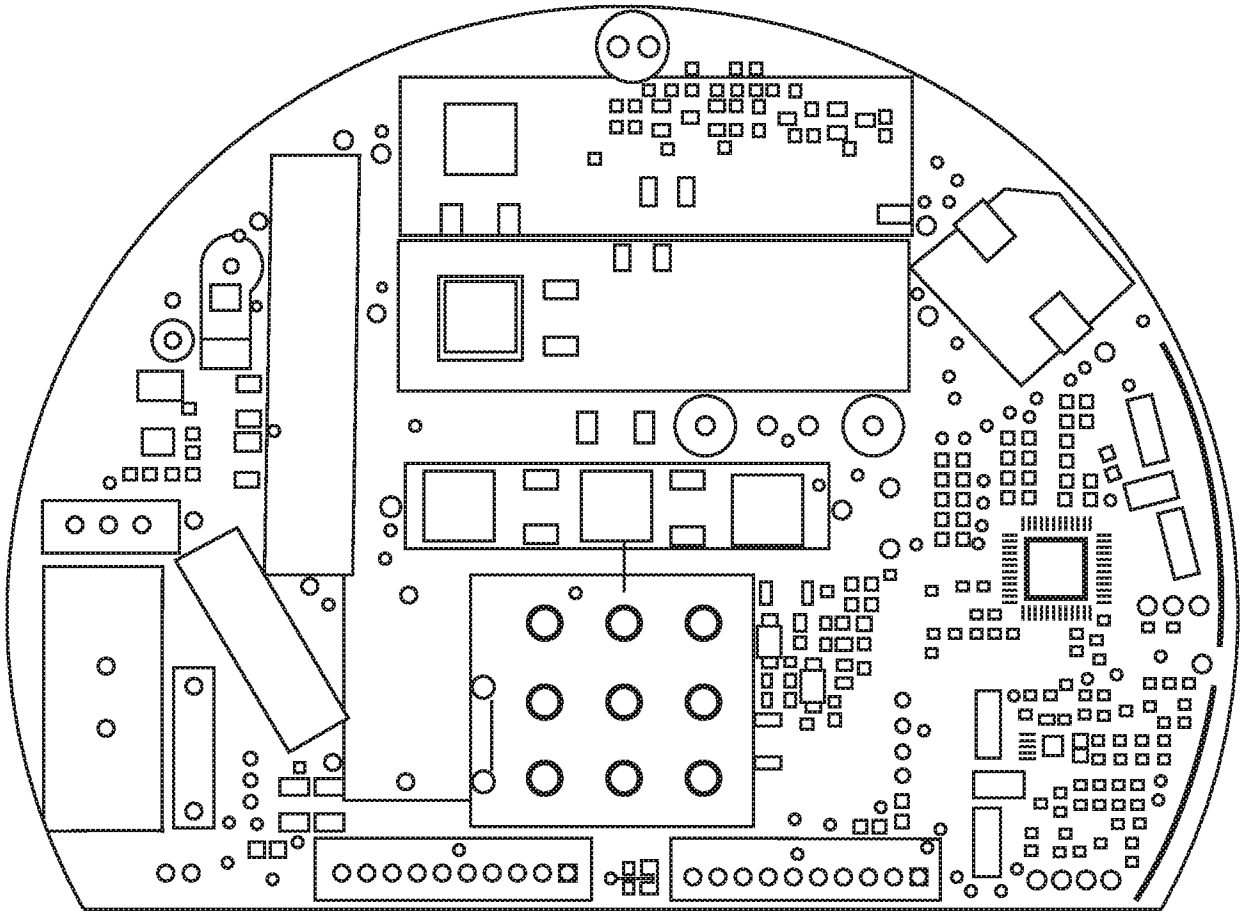
FIG. 21 is an illustrative view of a printed circuit board layout including the layout of an audible feedback circuit of FIG. 20.

Referring now to FIG. 20, fan controller 400 may comprise an audible feedback circuit 2000 for providing audible feedback to its users. According to one embodiment, an audible feedback circuit may be a piezoelectric drive circuit including two pins for digital control: pz_Duration and pz_Frequency. The pz_Duration signal may be used to activate the sound. The sound duration may be controlled by how long the pz_Duration signal is inactive (i.e., the longer the pulse is active the longer the sounds will be on). The pz_Frequency signal is used to modulate the fundamental frequency of the piezoelectric transducer. In one embodiment, the frequency is a fixed frequency, 50% duty cycle square wave. In another embodiment, the pz_Frequency must be active longer than that of the pz_Duration signal due to the hardware decay provided by C30. FIG. 21 shows the location of the audible feedback circuit on the printed circuit board according to one example embodiment. Other locations may be used as desired by one of ordinary skill in the art.

Figure 22:
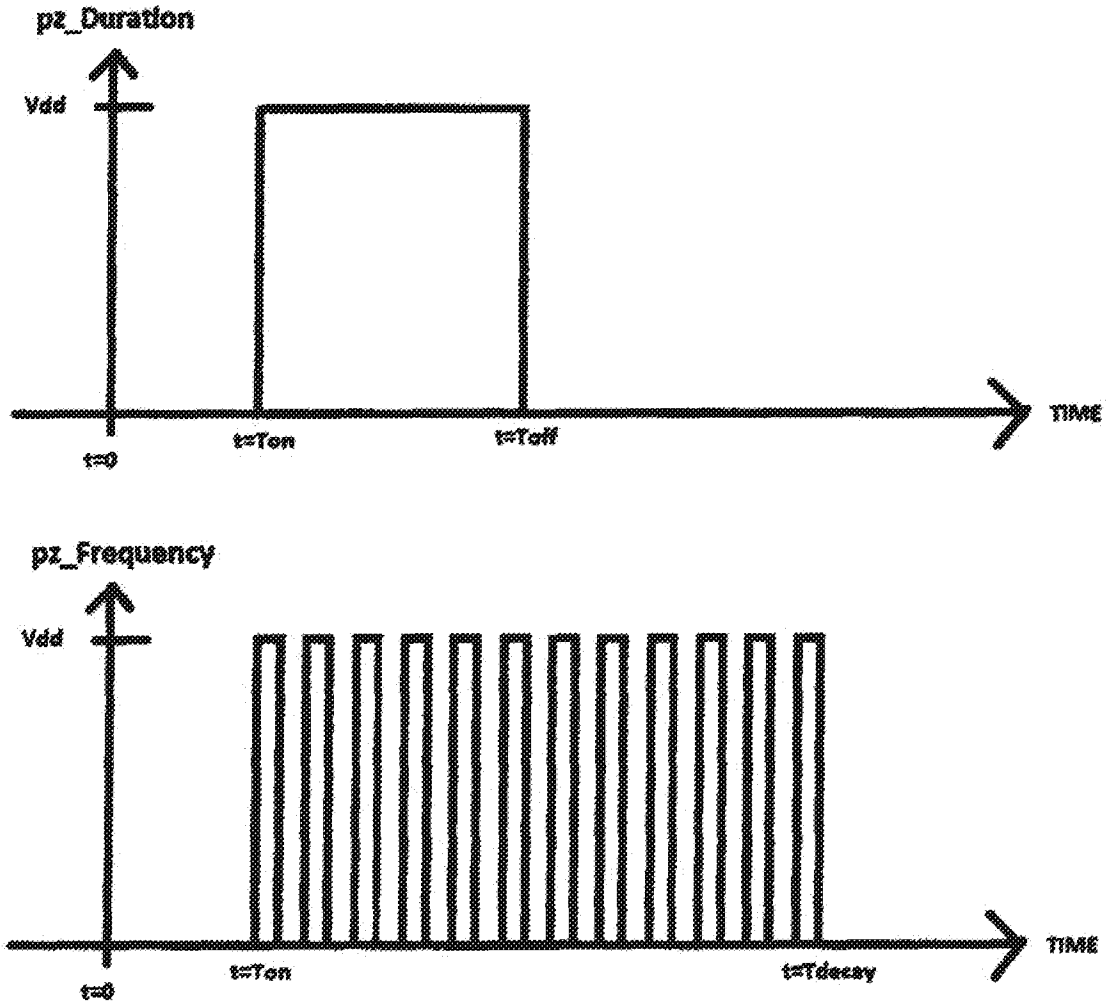
FIG. 22 is an illustrative view of audible signal diagrams.

Referring now to FIG. 22, the pz_Duration signal is active (i.e. audible) at time=Ton. The pz_Duration signal is held active until time=Toff which indicates the start of the decay period whereby the sound will audible until Tdecay. The pz_Frequency is active the entire time from Ton until Tdecay. Because the signal cannot activate the sound by itself, it is safe to have pz_Frequency active before Ton or after Tdecay. In one embodiment, values for parameters under firmware control include:

| Parameter | Minimum | Typical | Maximum | Comment |
|---|---|---|---|---|
| pz_Duration | 10 ms | 50 ms | 10 seconds | The relative time sound is on. |
| pz_Frequency | 1 kHz | 2 kHz | 20 kHz | The fundamental frequency of sound |

Figure 23:
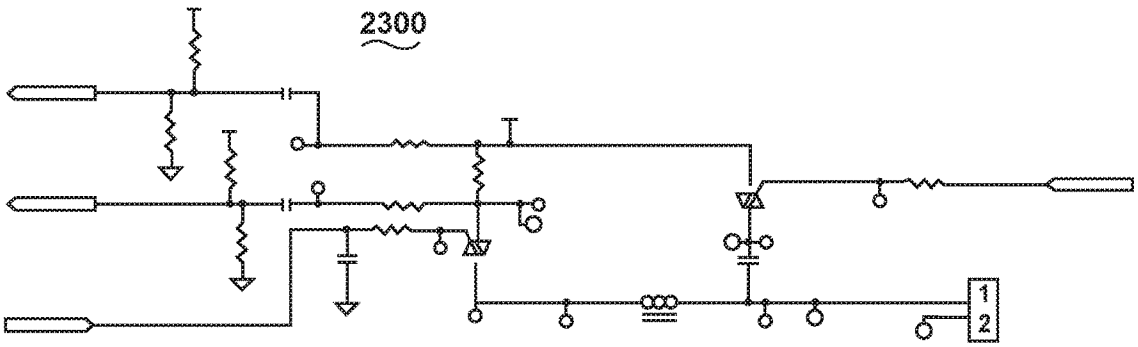
FIG. 23 is a schematic wiring diagram of an onboard light control circuit.
Figure 24:
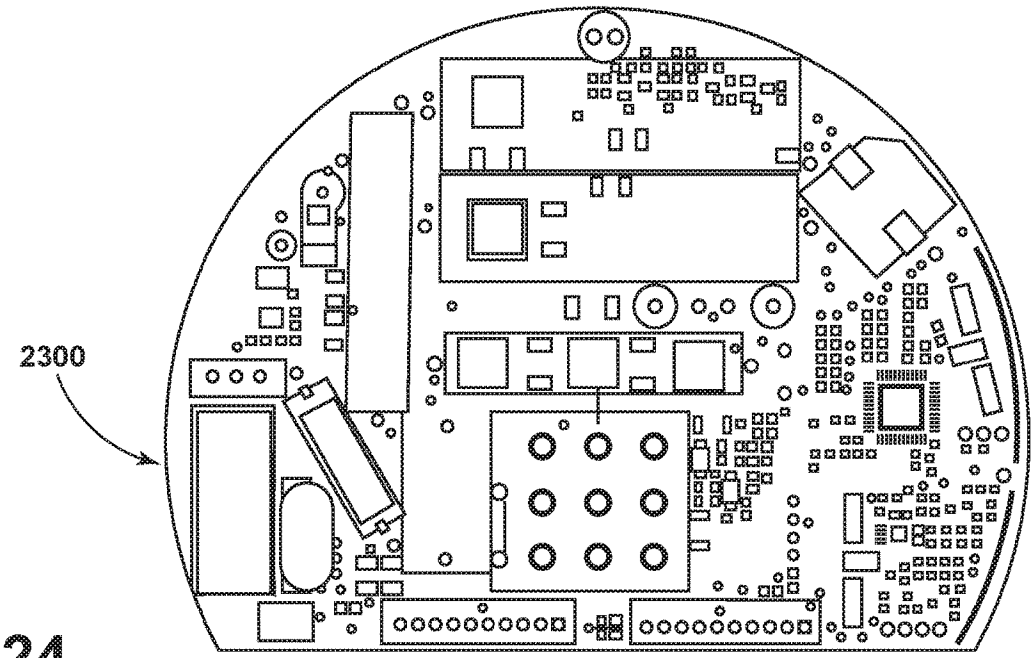
FIG. 24 is an illustrative view of a printed circuit board layout including the onboard light control circuit of FIG. 23.

Referring FIGS. 23 to 24, in one embodiment, the fan controller 400 may comprise an on-board light control circuit 2300. In one embodiment, the light control circuit 2300 may drive both dimmable and non-dimmable lights. Such circuitry may also comprise an auto-detect feature which will auto-detect if a light is dimmable and also provide overload and short circuit protection. FIG. 24 shows the location of the on board light control circuit 2300 on the printed circuit board according to one example embodiment. Other locations for the light control circuit may be used as desired by one of ordinary skill in the art.

Figure 25:
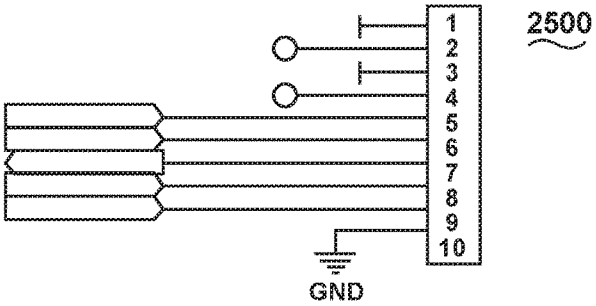
FIG. 25 is an illustrative view of an interface for controlling an off-board light circuit.
Figure 26:
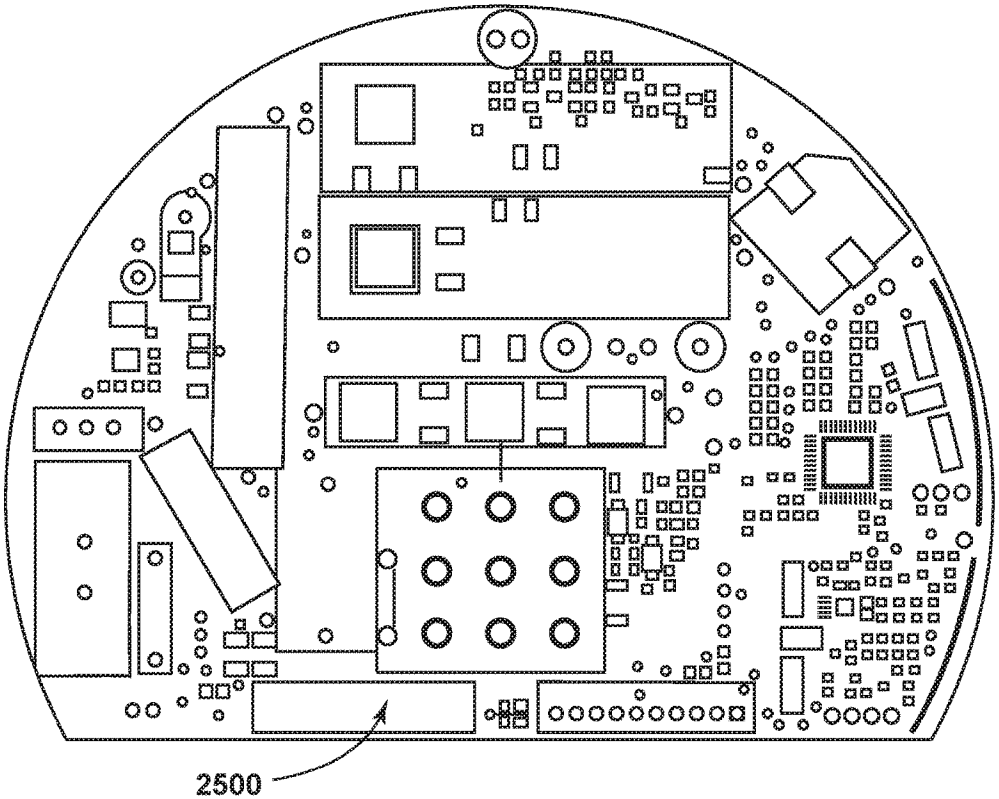
FIG. 26 is an illustrative view of a printed circuit board layout including the off-board circuit of FIG. 25.

The fan controller 400 may comprise an interface for controlling an off-board light interface as shown in FIGS. 25 and 26. In one embodiment, the external light control circuit 2500 has the same functionality as the onboard light circuitry plus the additional ability to interface to additional LED driver controllers. FIG. 26 shows the location of the off-board light control circuit 2500 on the printed circuit board according to one example embodiment. Other locations for the off board light control circuit 2500 may be used as desired by one of ordinary skill in the art.

Figure 27:
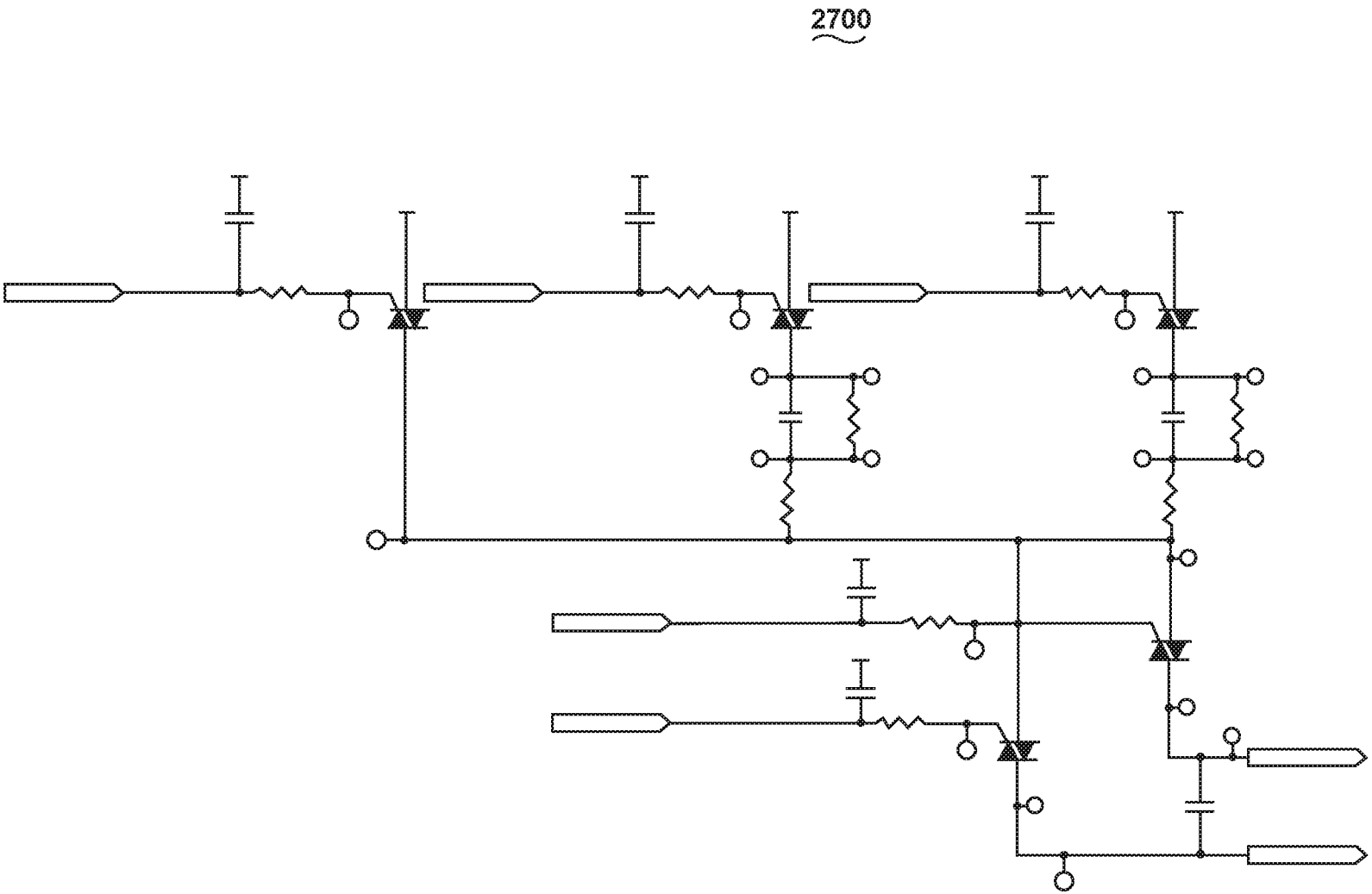
FIG. 27 is a schematic wiring diagram of a fan circuit.
Figure 28:
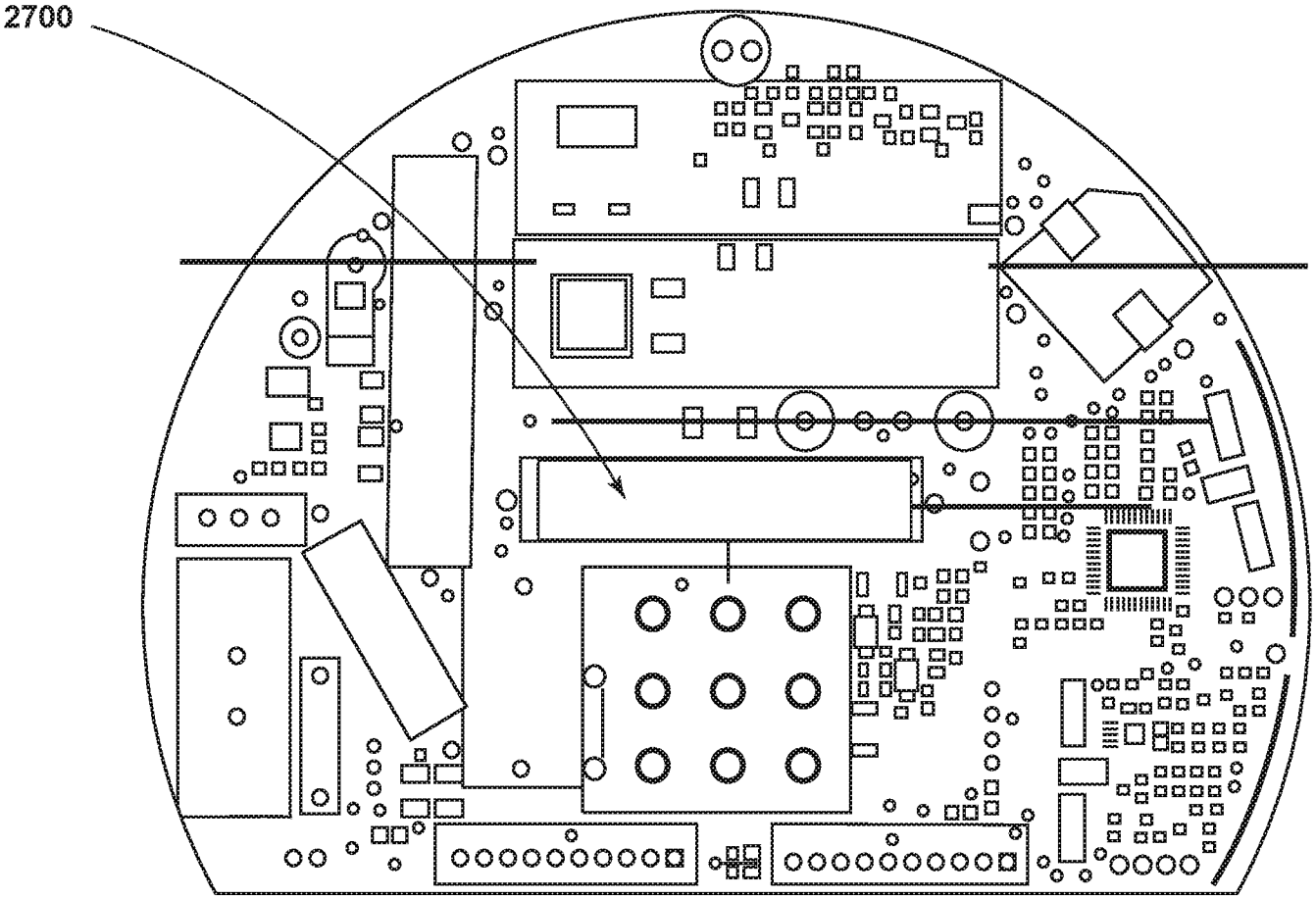
FIG. 28 is an illustrative view of a printed circuit board layout including the fan circuit of FIG. 27.

Referring now to FIGS. 27 and 28, fan controller 400 may comprise the driver electronics integrated onboard to drive the fan motor. FIG. 27 shows the fan driver circuit 2700 according to one example embodiment. The driver circuit 2700 may drive an AC split capacitor fan motor at four distinct speeds. The circuit 2700 can also control the rotary directions with the triacs Q9 and Q10. The circuit 2700 allows for a reverse relay which allows control of both sides of the windings allowing for faster braking of the motor. The circuit 2700 additionally allows for the ability to change direction (summer and winter settings) and provides the known direction of the fan, the data from which can be used to graphically depict the operation of the fan and better inform the consumer. In one embodiment, an integrated starter capacitor is onboard. FIG. 28 shows the location of the fan driver circuit 2700 on the printed circuit board according to one example embodiment. Other locations for the fan driver circuit may be used as desired by one of ordinary skill in the art.

In one embodiment, the electronic ceiling fan control system comprises a fan controller 400 which may be controlled by a wireless control device. The wireless control device (or wireless device) may be a smart phone, personal digital assistant (pda), laptop, personal computer, MP3 player, gaming device, television, tablet device or any other Internet Protocol-enabled device.

The wireless control device may be operable to communicate data messages via wireless signals such as radio frequency signals to one or more fan controllers via a direct wireless communication link, such as a Bluetooth communication technology owned by Bluetooth Sig, Inc. The wireless control device may be operable to establish a wireless communication link with a plurality of fan controllers. The Bluetooth Specification defines a uniform structure for a wide range of devices to connect and communicate with each other. The wireless control device communicates data messages to and from the fan controller via Bluetooth Smart Technology. Bluetooth Smart Technology includes Bluetooth low energy protocols. Bluetooth low energy (BTLE) is a subset of Bluetooth v4.0 and includes a protocol stack for rapid build-up of simple links. BTLE is aimed at low power applications running off a coin cell. BTLE chip designs allow for two types of implementation, dual-mode and single-mode, as well as enhanced past versions. In a single mode implementation, the low energy protocol stack is implemented solely. Single mode chips feature a lightweight Link Layer providing simple device discovery, ultra-power idle mode operation, and reliable point-to-multipoint data transfer. Such data transfer is made with advanced power-save and secure encrypted connections. Bluetooth technology transfers data within a user's Personal Area Network at distances up to 100 meters, depending on device implementation. Bluetooth technology operates in the unlicensed industrial, scientific and medical (ISM) band at 2.4 to 2.485 GHz, using a spread spectrum, frequency hopping, full-duplex signal at a nominal rate of 1600 hops/sec. The wireless device includes a small computer chip containing the Bluetooth radio transmitter and software operable to connect and transfer data, via a wireless communication link, to the fan controller which includes a receiver and software operable to receive and process data.

In another example embodiment, the wireless device may transmit data messages to the fan controller via any other wireless communication link, such as Wi-Fi communication or wireless network.

The wireless device may have an electronic visual display having a touch screen which allows the user to interact with the visual display through simple or multi-touch gestures by touching the screen with one or more fingers. The wireless control device may download a product control application which may allow the user to operate and control the fan control system.

Wireless control device displays a plurality of soft buttons and controls for the user to manipulate to control the fan load. In one embodiment, when utilizing a product control application to control fan load, a series of screenshots may be displayed on wireless control device. Upon launching a product control application via wireless device, a home screenshot may be displayed via electronic visual display while the application is launching as well as locating and connecting wireless control device with one or more nearby fan controllers. Wireless device may pair with any number of fan controllers in the event such fan controller is located within 100 feet of the wireless device. Once a wireless device locates and pairs with one or more fan controllers, a product control application may display a screenshot which demonstrates each fan controller with which the wireless device is now capable of transmitting data messages. If the wireless device attempts to pair with a fan controller but such fan controller is not visible, such fan controller may not be displayed and may be "greyed out" via the product control application. A fan controller may be greyed out when the wireless device is outside of the range of the fan controller. When this happens, the product control application will show the fan controller greyed out and thus such fan controller is not operable by wireless device. The product control application may refer to or designate each fan controller as a zone. It should be understood that other various designations other than "zone" may be used as desired by one of skill in the art.

Each fan controller (or zone) has a receiving unit or receiver located within a particular ceiling fan. In order to pair fan controller with a wireless control device, the receiving unit may be required to undergo a power cycle procedure before allowing the user to select the pair option on the screenshot during the configuration process. Such pairing between the receiving unit of fan controller and wireless control device allows wireless control device to transmit radio frequency signals to the receiving unit of one or more ceiling fans. The control device transmits wireless signals to the fan controller on a first frequency (for example, Bluetooth).

The foregoing disclosure has been set forth merely to illustrate the invention and is not intended to be limiting. Since modification of the disclosed embodiments incorporating the spirit and substance of the invention may occur to persons skilled in the art, the invention should be construed to include everything within the scope of the disclosed invention and equivalents thereof.

The above-described embodiments provide a variety of benefits including providing a circuit that requires only single digital input from a microprocessor to detect the tri-state mode of a 3-way switch input. Another benefit includes providing an integrated solution that reduces the cost by integrating the motor control functions inside a single integrated circuit. That is, the processing, radio frequency control and communication, and motor control circuits are integrated inside of the single chip which reduces the board area required for the circuitry and allows for a tighter packaged product. Another benefit includes providing a low-cost isolated discrete digital interface with an isolation barrier by using a pulse-width modulated (PWM) digital pulse to excite a passive electrical circuit which provides an advantage over other solutions that include several components, including directional buffers, isolation barriers (inductive or capacitive) and a DC to DC converter to provide power to the isolated circuit in order to achieve an isolated discrete digital interface.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure. These features may be combined in any suitable manner to modify the above embodiments and create new embodiments.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A control for a ceiling fan comprising:

a controller having a housing;

a first printed circuit board provided within the housing including:

a wireless communication module fixed to the first printed circuit board, and an electronic circuit coupled with the wireless communication module and configured to operate the ceiling fan;

a wired remote control device including an electronic cable with a connector at a first end of the electronic cable removably connectable to the first printed circuit board and a user interface at a second end of the electronic cable having at least one pushbutton, and the user interface dangling from the housing and including a second printed circuit board, and the user interface operable by the user to control operation of the ceiling fan at the user interface via the at least one pushbutton; and a wireless control device communicable with the wireless communication module and configured to control operation of the ceiling fan;

wherein the electronic circuit is operable to receive radio signals from the wired remote control device and the wireless communication module operable to receive signals from the wireless control device.

2. The control of claim 1 wherein the wired remote control device includes an isolated discrete digital interface for communication to the electronic circuit of the first printed circuit board.

3. The control of claim 2 wherein the isolated discrete digital interface includes a capacitive or inductive isolation barrier.

4. The control of claim 1 wherein the connector includes a jack plug and the wired remote control device is removably connectable to the first printed circuit board with the jack plug.

5. The control of claim 1 wherein the electronic cable is an audio cable.

6. The control of claim 1 wherein the at least one pushbutton on the user interface includes at least two pushbuttons operably coupled to the second printed circuit board.

7. The control of claim 1 wherein the electronic circuit is configured to reverse a direction of rotation of a plurality of fan blades in response to activation of the user interface.

8. The control of claim 1 wherein the signals from the wired remote control device are pulse width modulated.

9. The control of claim 1 wherein the first printed circuit board further includes a wall switch monitor configured to detect a state of an external light switch.

10. The control of claim 1 further including a capacitive, transformerless power supply.

11. The control of claim 1 wherein the wireless communication module is configured to communicate by radio frequency, infrared, pairing in a piconet, near-field communication (NFC) or Wi-Fi.

12. A ceiling fan comprising:

a fan motor housing;

a motor positioned within the motor housing;

a plurality of fan blades rotatable by the motor;

a fan controller comprising a first printed circuit board having a wireless communication module and an electronic circuit coupled with the wireless communication module and configured to control the motor to rotate the plurality of fan blades;

a wired remote control device including an electronic cable with a connector at a first end of the electronic cable removably connectable to the first printed circuit board and a user interface at a second end of the electronic cable dangling from the fan controller and including a second printed circuit board; and a wireless control device communicable with the wireless communication module;

wherein the electronic circuit is operable to receive radio signals from the wired remote control device input by a user at the user interface and the wireless communication module to control operation of the ceiling fan.

13. The ceiling fan of claim 12 further including at least one light wherein the electronic circuit is further configured to control the at least one light in response to the radio signals from the wired remote control device.

14. The ceiling fan of claim 12 wherein the wired remote control device includes an isolated discrete digital interface for communication to the electronic circuit of the first printed circuit board.

15. The ceiling fan of claim 12 wherein the connector includes a jack plug connector and the user interface includes at least two pushbuttons.

16. The ceiling fan of claim 12 wherein the first printed circuit board further includes a wall switch monitor configured to detect a state of an external light switch.

17. The ceiling fan of claim 12 further including a capacitive, transformerless power supply.

18. The ceiling fan of claim 12 wherein the wireless communication module is configured to communicate by radio frequency, infrared, pairing in a piconet, near-field communication (NFC) or Wi-Fi.

* * * * *